US006189362B1

(12) United States Patent
Nagao et al.

(10) Patent No.: US 6,189,362 B1
(45) Date of Patent: Feb. 20, 2001

(54) FORGING DIE APPARATUS

(75) Inventors: Yuichi Nagao, Omiya; Yoshihisa Doi; Tsukashi Ohama, both of Utsunomiya, all of (JP)

(73) Assignee: Honda Giken Kogyo Kabushiki Kaisha, Tokyo (JP)

( * ) Notice: Under 35 U.S.C. 154(b), the term of this patent shall be extended for 0 days.

(21) Appl. No.: 09/487,884

(22) Filed: Jan. 20, 2000

Related U.S. Application Data

(62) Division of application No. 09/177,364, filed on Oct. 23, 1998, now Pat. No. 6,035,688.

(30) Foreign Application Priority Data

| | | |
|---|---|---|
| Dec. 5, 1997 | (JP) | 9-335893 |
| Dec. 5, 1997 | (JP) | 9-335912 |
| Dec. 5, 1997 | (JP) | 9-335916 |
| Dec. 5, 1997 | (JP) | 9-335923 |
| Dec. 5, 1997 | (JP) | 9-335931 |

(51) Int. Cl.[7] ..... B21J 13/14
(52) U.S. Cl. ..... 72/344
(58) Field of Search ..... 72/344, 354.6, 72/354.8, 355.2, 355.6, 361

(56) References Cited

U.S. PATENT DOCUMENTS

| | | | | |
|---|---|---|---|---|
| 1,640,964 | * | 8/1927 | Schlaupitz et al. | 72/353.2 |
| 1,910,384 | * | 5/1933 | Eksergian et al. | 72/355.2 |
| 3,748,887 | * | 7/1973 | Widera | 72/361 |
| 4,426,872 | | 2/1984 | Gatny . | |

FOREIGN PATENT DOCUMENTS

| | | |
|---|---|---|
| 61-255737 | 11/1986 | (JP) . |
| 7178493 | 7/1995 | (JP) . |

* cited by examiner

*Primary Examiner*—Lowell A. Larson
(74) *Attorney, Agent, or Firm*—Birch, Stewart, Kolasch & Birch, LLP

(57) ABSTRACT

A forging die apparatus comprises a punch for applying a pressurizing force to a forging material arranged in a cavity, a cylindrical member installed to surround a part of outer circumference of the punch, for making displacement integrally with the punch, and a first ring member formed with a hole for forcibly inserting the cylindrical member therein when the punch applies the pressurizing force to the forging material.

5 Claims, 36 Drawing Sheets

FORGING DIE APPARATUS

This application is a divisional of application Ser. No. 09/177,364, filed on Oct. 23, 1998, now U.S. Pat. No. 6,035,688, the entire contents of which are hereby incorporated by reference.

BACKGROUND OF THE INVENTION

1. Field of the Invention

The present invention relates to a forging die apparatus for processing a forging material arranged in a cavity formed by a die member so that the forging material is subjected to forging in accordance with a pressurizing action of a punch.

2. Description of the Related Art

A die apparatus has been hitherto known, in which a forging material is inserted into a cavity formed by an upper die and a lower die which are joined to one another, and a pressurizing force is applied to the forging material by the aid of a punch so that the forging material is forged to have a predetermined shape.

A cold forging die suggested by the present applicant is shown in FIG. 39 (see Japanese Laid-Open Patent Publication No. 7-178493).

The cold forging die 1 comprises a lower die 3 and an upper die 4 which are joined to one another by the aid of a clamping means 2 and which are installed on a die holder 5. A cavity 7, which is charged with a forging material 6, is formed by the lower die 3 and the upper die 4. A punch 8 is provided to pressurize the forging material 6 charged in the cavity 7.

A general forging die apparatus including the cold forging die 1 is usually designed, as shown in FIG. 40, such that a predetermined clearance A (about 0.1 mm) is provided between the punch 8 for applying the pressurizing force to the forging material 6 and a hole 9 of the upper die 4 into which the punch 8 is inserted. In other words, the hole 9 of the upper die 4, into which the punch 8 is inserted, has a diameter which is formed to be slightly larger than a diameter of the punch 8 at its portion which is inserted into the hole 9 of the upper die 4.

In this case, if the clearance A is small, the following inconvenience arises. That is, the punch 8 generates heat as the number of shots is increased. As a result, scuffing occurs on an outer circumferential surface of the punch 8 and on an inner wall surface of the hole 9 of the upper die 4 respectively.

Since the clearance A is provided, the upper die 4 and the lower die 3 are assembled in a state of involving any centering deviation within a range of the clearance A. Further, if any unbalanced load is applied in the lateral direction to the punch 8 during the forging, the pressurizing force is applied to the forging material 6 in a state in which the punch 8 is deviated in the lateral direction within the range of the clearance A.

As described above, the clearance A causes the centering deviation between the punch 8 and the cavity 7 which is formed by the upper and lower dies 4, 3. For example, when an outer cup for constructing a constant velocity universal joint is formed by forging, an inconvenience arises in that the axis of a cup of the outer cup is not coincident with the axis of a shaft thereof, i.e., the centering deviation occurs.

In the case of the cold forging die 1 described above, a clearance (not shown) is formed during the forming process at a joining surface (dividing surface) 10 (see FIG. 40) between the upper die 4 and the lower die 3. It is feared that any burr is formed by the plastically deformed forging material 6 which has entered the clearance (not shown).

An unillustrated clearance for assembling is provided at a joined section 11 based on a step section between the upper die 4 and the lower die 3 (see FIG. 39). As a result, the upper die 4 and the lower die 3 are assembled in a state in which they involve centering deviation within a range of the clearance. Therefore, there is a fear that it is possible to highly accurately maintain the coaxial degree of a product obtained by the forging, for example, the coaxial degree between the shaft and the cup of the outer cup for constructing the constant velocity universal joint.

The present applicant has already suggested a method for cooling a die which makes it possible to greatly enhance the cooling effect and improve the service life of the die (life of the die) (see Japanese Laid-Open Patent Publication No. 61-255737).

That is, as shown in FIGS. 41 and 42, the following method has been adopted. A predetermined amount of a lubricant is allowed to flow into a cavity 21 from the top. The lubricant is discharged from the cavity 21 via an outflow groove 23 formed on a knockout pin 22. After that, air is introduced into the cavity 21 via a passage 24 which communicates with the outflow groove 23. Thus, the die, which is composed of an upper die 25 and a lower die 26, is cooled. Reference numeral 27 indicates a billet after being subjected to the forging applied with a pressurizing force by the aid of a punch 28.

A mechanical press 31 as shown in FIG. 43 is generally known as a processing machine for allowing the punch to perform reciprocating motion. The mechanical press 31 is composed of a crank press having a crank mechanism, and it comprises frames 33*a*, 33*b* provided vertically on a bolster 32, a crank shaft 34 rotatably supported by the frames 33*a*, 33*b*, and a ram 36 for performing reciprocating motion in the vertical direction in accordance with the guiding action of the frames 33*a*, 33*b* by the aid of a connecting rod 35 connected to the crank shaft 34.

A material 38 is arranged on a die member 37 on the upper surface of the bolster 32. A punch 39, which is fixed to the ram 36, performs reciprocating motion in the vertical direction integrally with the ram 36 to apply a pressurizing force to the material 38. Thus, the material 38 is forged to have a predetermined shape.

In the crank press, the rotary driving force of the motor is transmitted to the crank shaft 34, and the force is converted into the reciprocating motion of the ram 36 and the punch 39 by the aid of the connecting rod 35 connected to the crank shaft 34 to generate the forming load to be applied to the material 38.

When the forging is performed by using the well known mechanical press 31 as described above, any elongation occurs, for example, in the frames 33*a*, 33*b*, the connecting rod 35, and the ram 36 for constructing the mechanical press 31. For this reason, the bottom dead center of the punch 39 which makes the vertical reciprocating motion is varied. As a result, an inconvenience arises in that any dispersion occurs in the dimension of an obtained forged product in the thickness direction.

For example, when an outer cup for constructing a constant velocity universal joint is formed by forging by using the mechanical press 31, dispersion occurs in the bottom thickness dimension of a cup of the outer cup due to the influence of the elongation.

Therefore, the conventional technique involves an inconvenience that cutting processing should be applied after the forging in order to obtain a constant bottom thickness dimension of the cup of the outer cup.

If the forming load, which is applied to the material, hugely exceeds a preset value due to the influence of the elongation (if a overloaded forming load is applied), the mechanical press 31 is stopped In a locked state, resulting in an inconvenience that it is impossible to perform continuous forming.

Further, the conventional die apparatus generally adopts a method in which a forged product is taken out by the aid of a knockout pin 43 provided movably back and forth in a hole 42 of a lower die 41. As shown in FIG. 44, a predetermined clearance C is provided between the columnar knockout pin 43 formed to have a substantially identical diameter over its outer circumferential surface and the hole 42 of the lower die 41 for inserting the knockout pin 43 thereinto.

When an outer cup for constructing a constant velocity universal joint is produced by using such a die apparatus, it is necessary to form an unillustrated centering hole at a center of one end of a shaft of the outer cup in order to apply finishing processing such as polishing. In this procedure, the centering hole is formed by mechanical processing by using a cutting tool such as a drill (including a machining center).

In view of the function of the constant velocity universal joint. the centering hole serves as a reference, for example, when grinding processing is performed for a portion for which the coaxial accuracy is required. Therefore, a high coaxial accuracy is required between the center of the centering hole and the cup and the shaft for constructing the outer cup.

However, in the case of the die apparatus concerning the conventional technique, any backlash occurs in a direction perpendicular to the axis when the knockout pin 43 makes forward and backward movement, resulting from the clearance C between the knockout pin 48 and the hole 42 of the lower die 41. Therefore, even if a projection (not shown) for forming the centering hole is provided at one end of the knockout pin 48 for constructing the die apparatus concerning the conventional technique, an inconvenience arises in that it is impossible to correctly form the centering hole at the center of one end of the shaft of the outer cup formed by the forging. As a result, the die apparatus concerning the conventional technique involves the following inconvenience. That is, the center of the centering hole formed by the projection of the knockout pin 43 is not coincident with the axis of the outer cup due the backlash as described above. Therefore, it is necessary to apply lace processing based on the reference of the centering hole to the outer circumferential surface of the outer cup formed by the forging in order to allow the center of the centering hole to coincide with the axis of the outer cup.

In this case, if the clearance C is made zero in order to avoid the backlash of the knockout pin 43, the knockout pin 43 is fastened by the hole 42, making it impossible to perform forward and backward movement. On the other hand, if the clearance C is made narrow, another inconvenience arises in that it is difficult to perform forward and backward movement of the knockout pin 48 due to the action of sliding friction with respect to the hole 42.

SUMMARY OF THE INVENTION

A general object of the present invention is to provide a forging die apparatus which makes it possible to maintain a highly accurate coaxial degree of a forged product obtained by forging.

A principal object of the present invention is to provide a forging die apparatus which makes it possible to suppress occurrence of scuffing between a punch and a die.

Another object of the present invention is to provide a forging die apparatus which makes it possible to assemble an upper die and a lower die in an integrated manner so that the coaxial degree is maintained highly accurately between the upper die and the lower die.

Still another object of the present invention is to provide a forging die apparatus which makes it possible to avoid occurrence of burr at a joining surface between an upper die and a lower die.

Still another object of the present invention is to provide a forging die apparatus which makes it possible to improve durability of a main punch body and a sleeve member by suppressing thermal expansion of the main punch body in accordance with the cooling action for the main punch body, which would be otherwise caused due to heat generated during forging of a material to which a pressurizing force is applied.

Still another object of the present invention is to provide a forging die apparatus which makes it possible to avoid any overloaded forming load without requiring any cutting processing and maintain a highly accurate thickness accuracy of an obtained forged product.

Still another object of the present invention is to provide a forging die apparatus which makes it possible to form a centering hole simultaneously with forging for a forging material and allowing a center of the centering hole formed by the forging to correctly coincide with an axis of the forging material.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
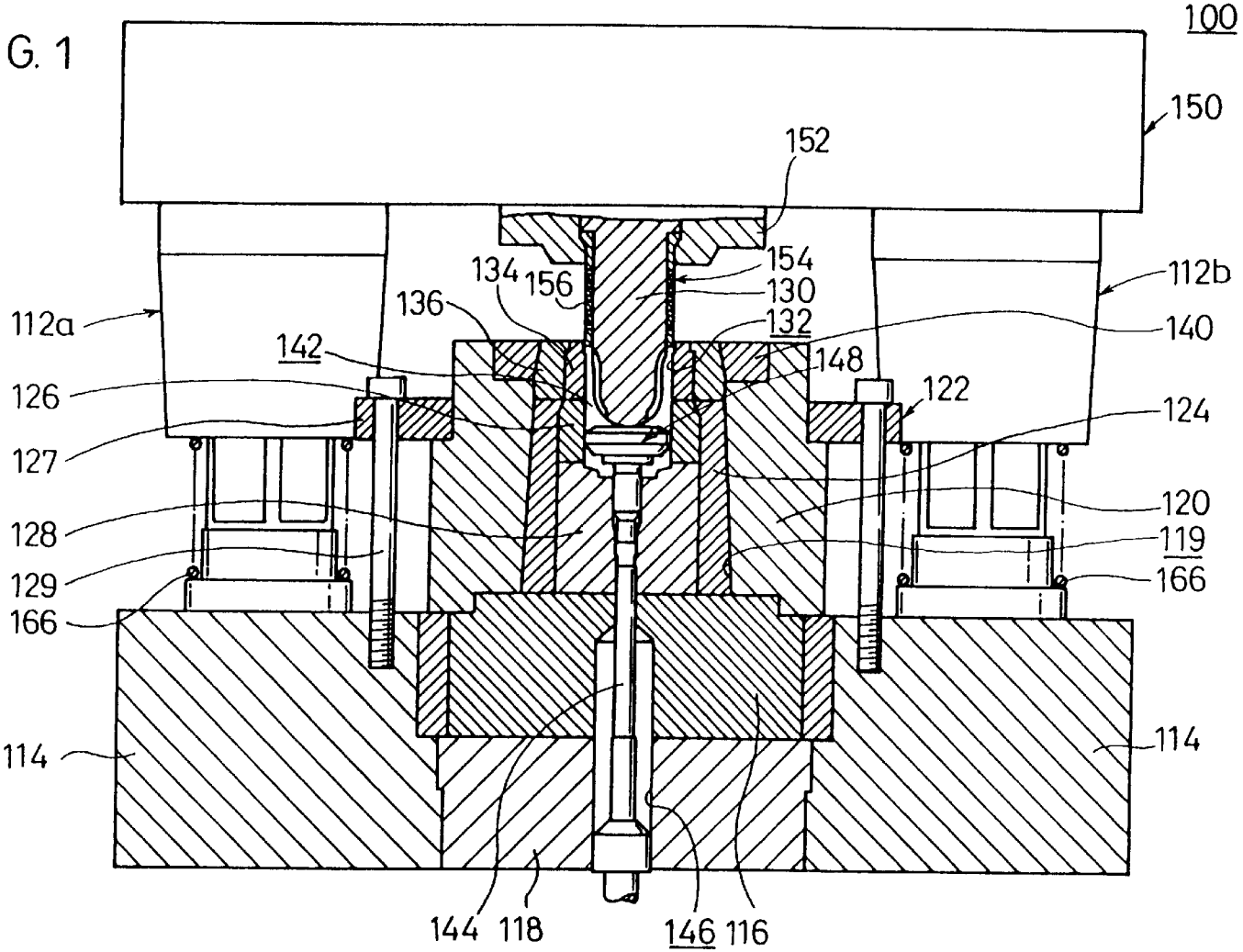
FIG. 1 shows a longitudinal sectional view illustrating a forging die apparatus according to a first embodiment of the present invention.
Figure 4:
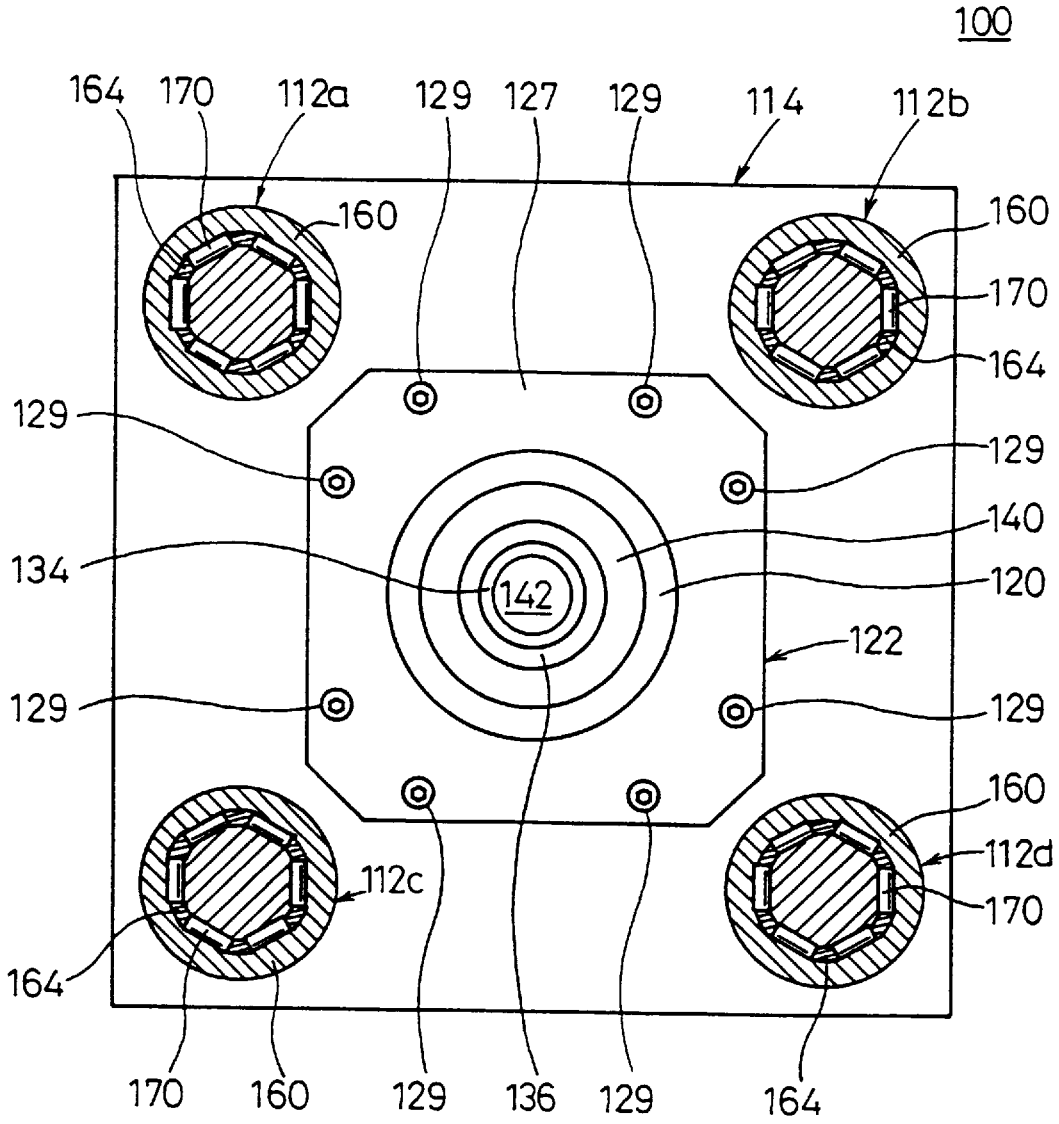
FIG. 4 shows a plan view, with partial cross section, illustrating the forging die apparatus shown in FIG. 1.

With reference to FIG. 1, reference numeral 100 indicates a forging die apparatus according to a first embodiment of the present invention. The forging die apparatus 100 comprises a first die holder 114 on which a plurality of guide means 112*a* to 112*d* (see FIG. 4) are vertically provided in the close vicinity of four corners, and second and third die holders 116, 118 which are provided and stacked at the center of the first die holder 114.

A thick-walled forcible insertion ring 120, which is formed in an integrated manner, is fixed on the second die holder 116 by the aid of a clamping means 122. An upper die 126 and a lower die 128 are integrally joined in a hole 119 of the forcible insertion ring 120 via a sleeve 124 which is formed to have a thin-walled cylindrical configuration.

Figure 3:
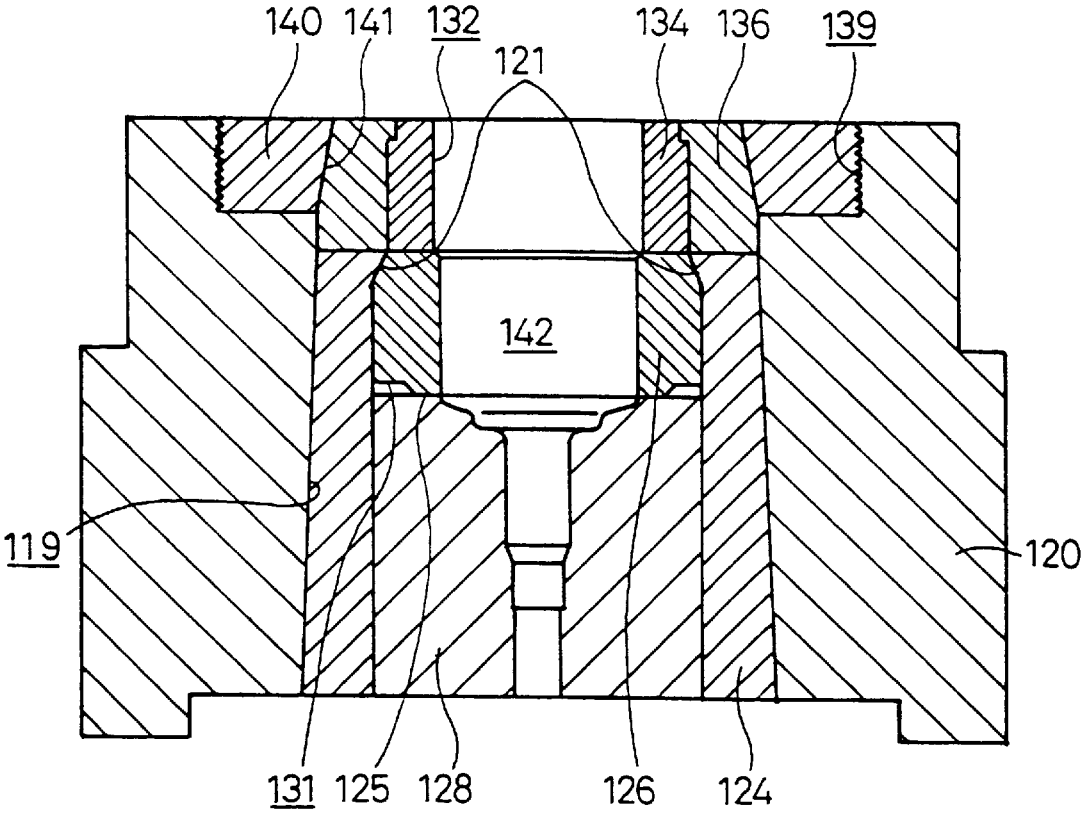
FIG. 3 shows a magnified longitudinal sectional view illustrating a die for constructing the forging die apparatus shown in FIG. 1.

As shown in FIG. 3, the hole 119 of the forcible insertion ring 120 is formed to have a tapered configuration in which the diameter is gradually reduced from its lower portion to its upper portion in an assembled state. The sleeve 124 has its outer circumferential surface which is formed to have an inverted tapered configuration corresponding to the hole 119. The upper die 126, the lower die 128, and the sleeve 124 are formed to be forcibly inserted into the hole 119 of the forcible insertion ring 120 as described later on.

A tapered inclined surface 121, in which the diameter is gradually reduced toward the upper end edge, is formed at an upper portion of the inner circumferential surface of the sleeve 124. The inclined surface 121 exerts a pressing force directed downwardly in the assembled state, and thus it functions to increase the surface pressure at the contact surface between the upper die 126 and the lower die 128.

Figure 14:
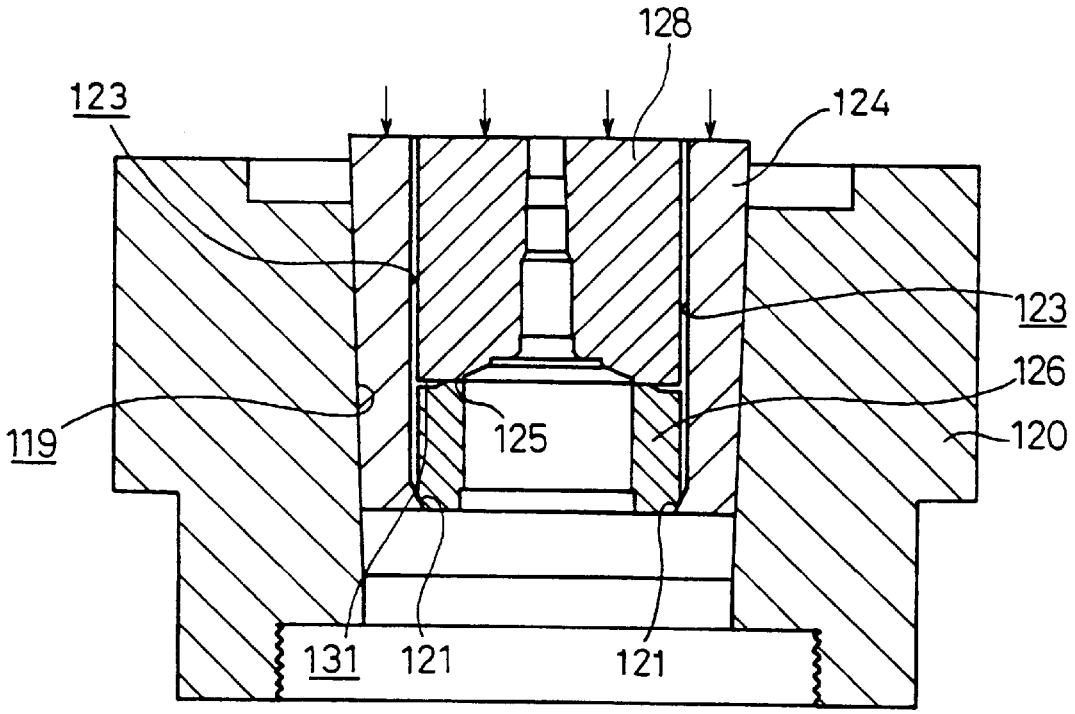
FIG. 14 shows a longitudinal sectional view illustrating a state in which an upper die and a lower die are forcibly inserted into a forcible insertion ring by the aid of a sleeve.

As shown in FIG. 14, the inner circumferential surface of the sleeve 124 is formed to be separated from the outer circumferential surfaces of the upper die 126 and the lower die 128 by a predetermined clearance 123 (about 0.02 mm) intervening therebetween, before the assembly. The outer circumferential surfaces of the upper die 126 and the lower die 128 have a substantially identical dimension along the axial direction, each of which is formed to give a linear cross section.

As shown in FIG. 3, an annular projection 125 for being joined to the flat upper surface of the lower die 128 is formed at the inner circumferential side on the lower surface of the upper die 126. A recess 131 for forming a clearance between itself and the flat upper surface of the lower die 128 is formed at the outer circumferential side on the lower surface of the upper die 126.

As shown in FIG. 1, the clamping means 122 includes a fixing plate 127 for engaging with a step section of the forcible insertion ring 120, and a plurality of bolts 129 for holding the fixing plate 127 with respect to the first die holder 114.

As shown in FIG. 3, a first ring member 134, which is formed with a hole 132 for forcibly inserting a punch 130 thereinto, is integrally joined to the upper surface of the upper die 126. A second ring member 136, which is externally fitted to the first ring member 134, is integrally joined to the upper surface of the sleeve 124. In this embodiment, the first ring member 134 and the second ring member 136 may be integrally formed as a ring member without forming them as separate members respectively.

Figure 7:
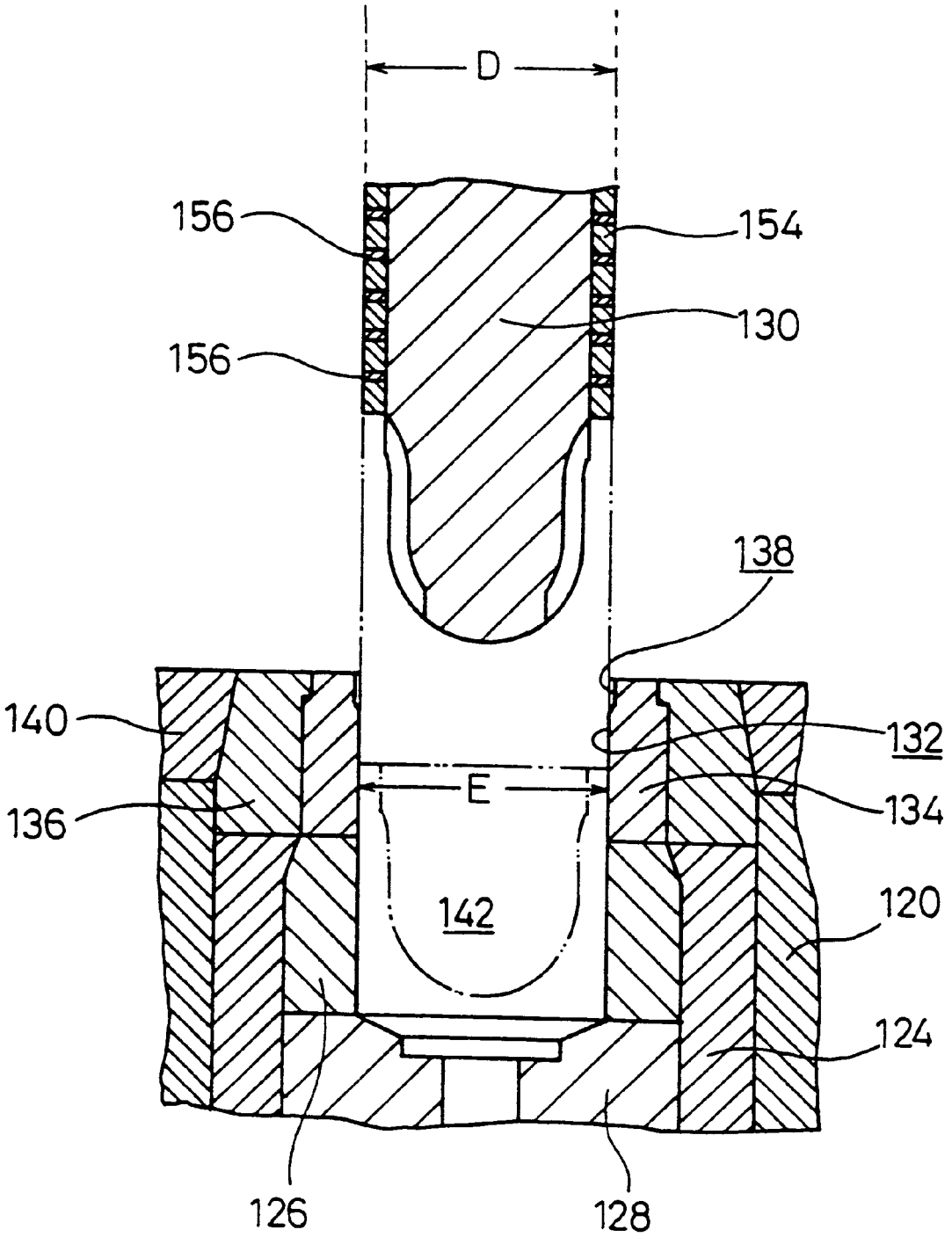
FIG. 7 shows a partial magnified longitudinal sectional view illustrating a state in which the punch and a cylindrical member are forcibly inserted into a first ring member.

As shown in FIG. 7, an annular groove 138 for guiding the punch 130 when the punch 130 is forcibly inserted may be formed beforehand at the upper portion of the hole 132 of the first ring member 134.

The first ring member 134 is formed of, for example, a cemented carbide material, and it is in a state of being strongly tightened toward the center by the second ring member 136 which has been subjected to the shrinkage fitting treatment. The first ring member 134 and the second ring member 136 are tightened by a tapered section 141 of a clamping ring 140 which is screwed into a screw hole 139 of the forcible insertion ring 120. Thus, the first ring member 134 and the second ring member 136 are joined to the upper die 126, the lower die 128, and the sleeve 124 in an integrated manner.

Figure 12:
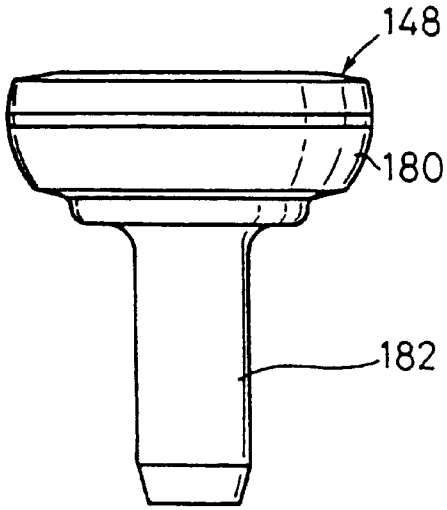
FIG. 12 shows a front view illustrating a secondary formed product obtained by applying secondary forging to the preform shown in FIG. 11.

In this embodiment, a cavity 142 is formed by the first ring member 134, the upper die 126, and the lower die 128. A knockout pin 144 for extruding a forged product is arranged on the lower side of the cavity 142, which is movable back and forth along a hole 146 formed through the second die holder 116 and the third die holder 118. A secondary formed product 148 as shown in FIGS. 1 and 12 is charged as a forging material in the cavity 142.

Figure 43:
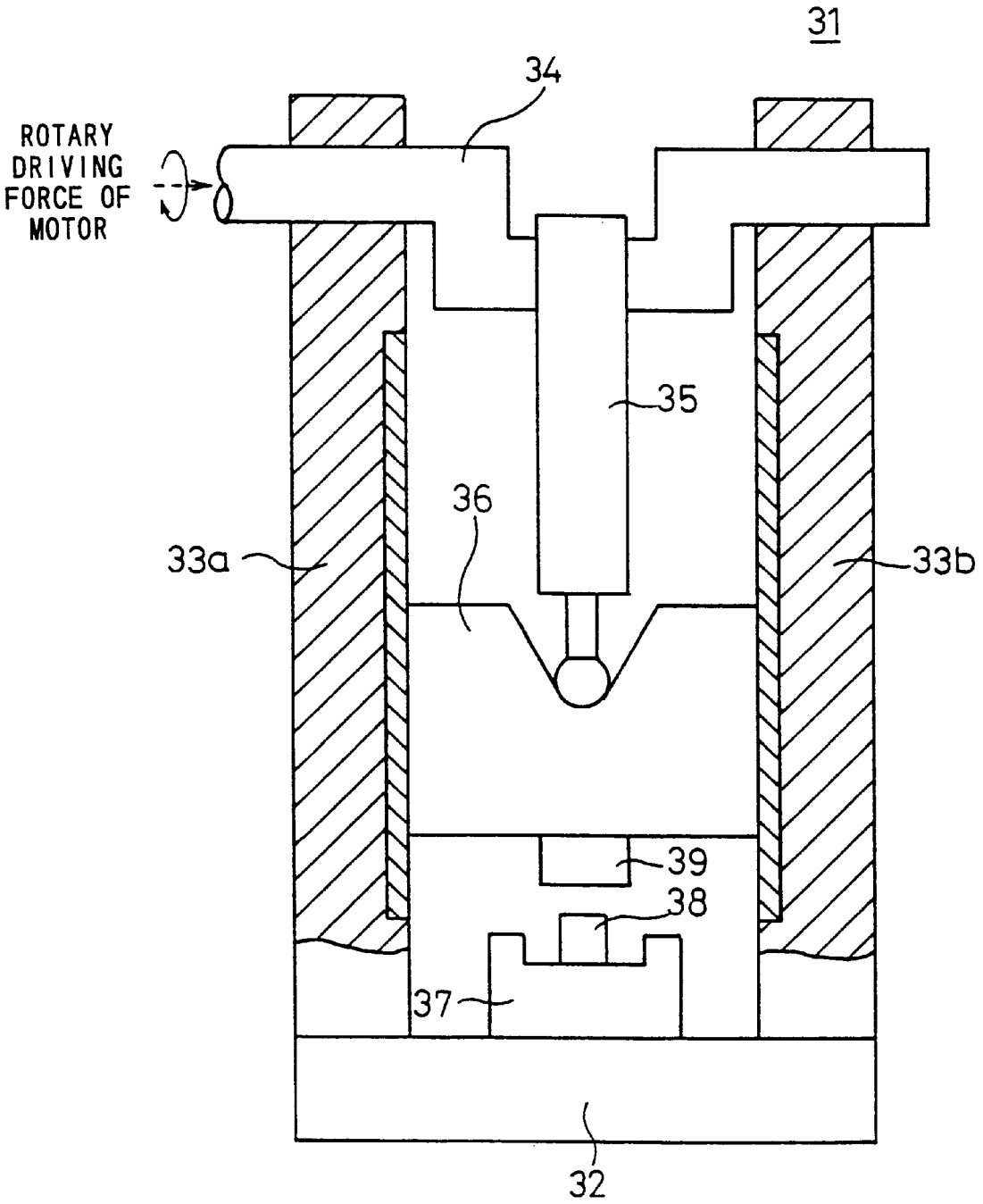
FIG. 43 shows a schematic arrangement of a mechanical press generally used as a processing machine for performing reciprocating motion of the punch.
Figure 44:
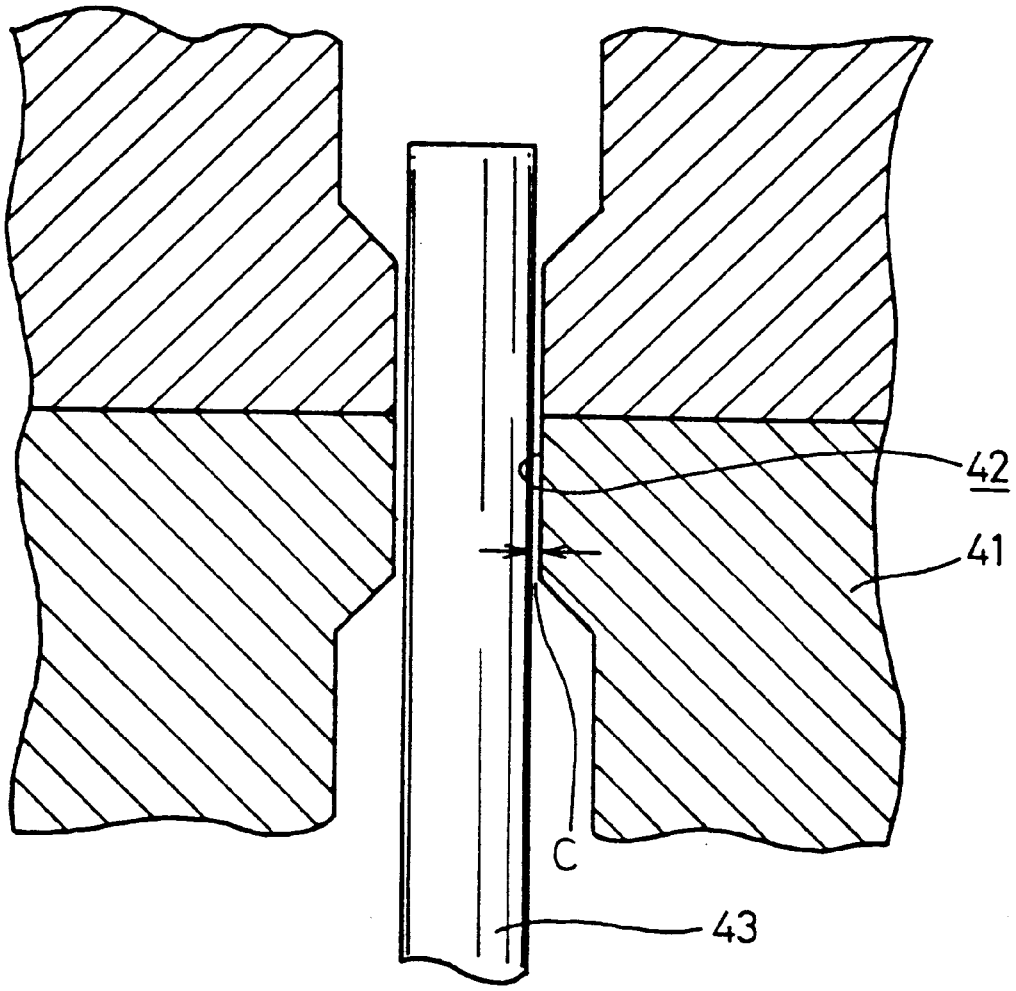
FIG. 44 shows a partial longitudinal sectional view illustrating a relationship between a knockout pin and a hole formed in a lower die, in relation to the forging die apparatus concerning the conventional technique.

An elevating member 150, which is connected to the ram 36 of the mechanical press 31 shown in FIG. 43 for making displacement along the vertical direction integrally with the ram 36 in accordance with the driving action of the mechanical press 31, is provided at an upper position separated by a predetermined distance from the forcible insertion ring 120. The punch 130 is fixed to the elevating member 150 by the aid of a jig 152. A cylindrical member 154, which is formed of a cylindrical metal material, is externally fitted to a predetermined portion of the outer circumference of the punch 130 (see FIGS. 1 and 7).

Figure 8:
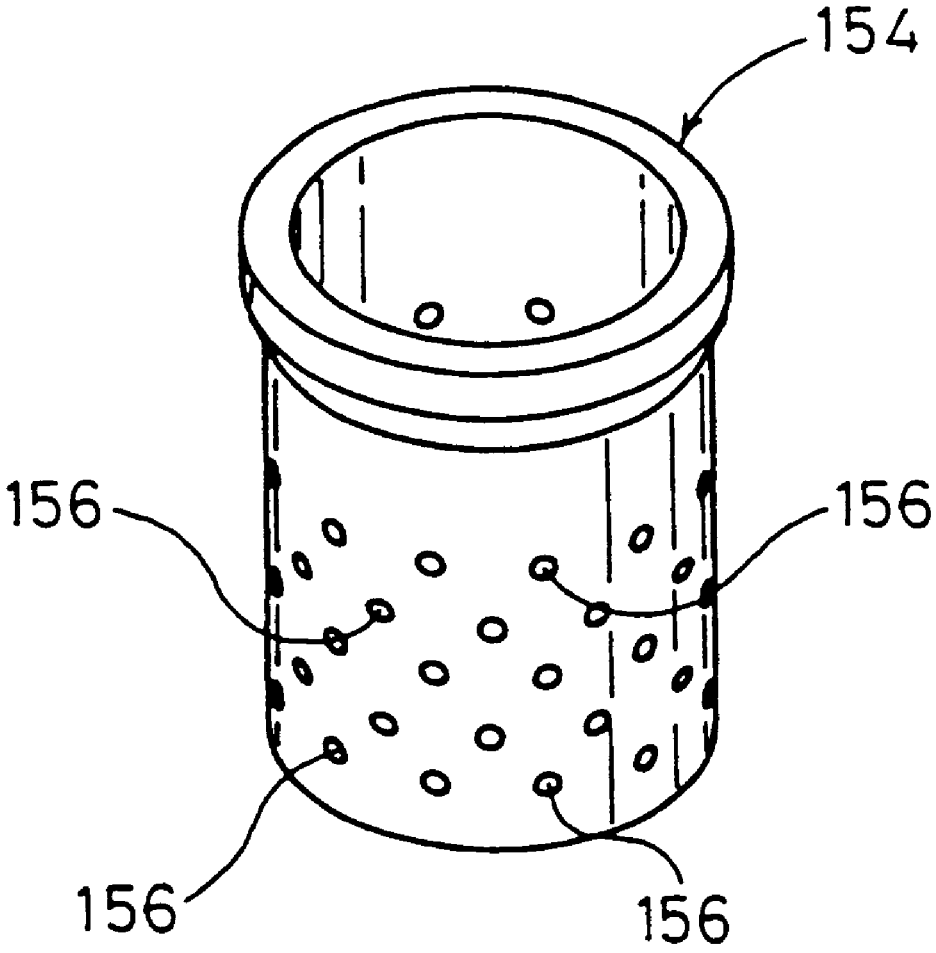
FIG. 8 shows a perspective view illustrating the cylindrical member externally fitted to the punch.

As shown in FIG. 8, graphite 156 is embedded in a plurality of holes of the cylindrical member 154, making it possible to appropriately maintain the lubricating characteristic when the cylindrical member 154 is forcibly inserted into the hole 132 of the first ring member 134. As shown in FIG. 7, the diameter D on the outer circumferential side of the cylindrical member 154 externally fitted to the punch 130 is set to be slightly larger than the diameter E on the inner circumferential side of the hole 132 of the first ring member 134.

The cylindrical member 154 is formed of a metal material such as SKD11, FC25, or FC30 (according to JIS). The first ring member 134 is preferably formed of a material harder than that for the cylindrical member 154 in order to avoid occurrence of scuffing.

The punch 130 is provided displaceably in the vertical direction integrally with the elevating member 150 in accordance with the guiding action of the plurality of guide means 112*a* to 112*d* provided vertically on the first die holder 114.

Figure 5:
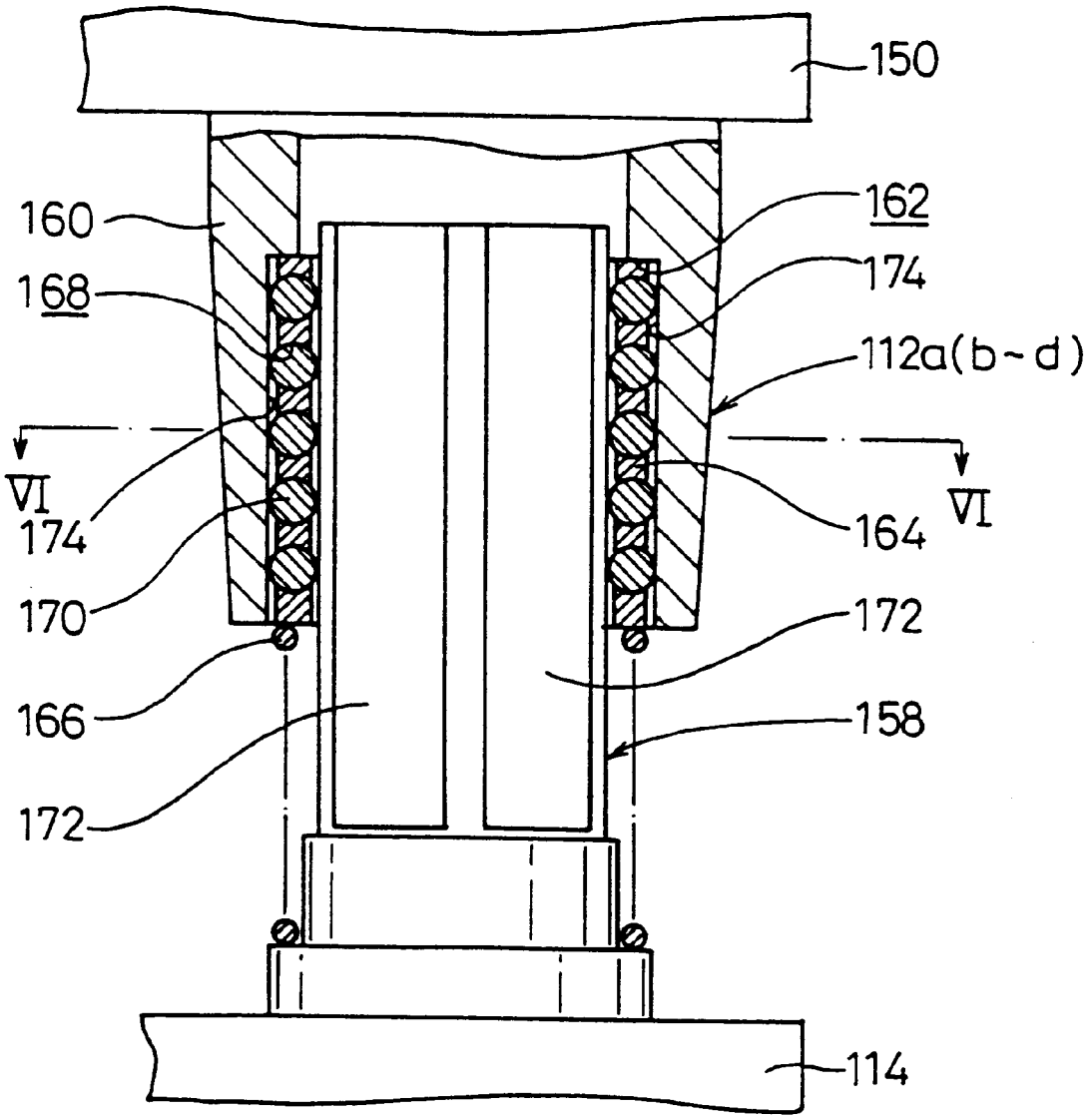
FIG. 5 shows a front view, with partial cross section, illustrating a guide means provided in the forging die apparatus shown in FIG. 1.

As shown in FIG. 5, the guide means 112*a* (112*b* to 112*d*) comprises a lengthy main post body 158 fixed to the first die holder 114, a cylindrical cover member 160 connected to the elevating member 150 for making displacement integrally with the elevating member 150, a guide ring 164 provided to surround an outer circumferential portion of the main post body 158 for making sliding displacement along the axial direction of the main post body 158 by engaging with an annular step section 162 of the cover member 160, and a spring member 166 for supporting the guide ring 164.

Figure 6:
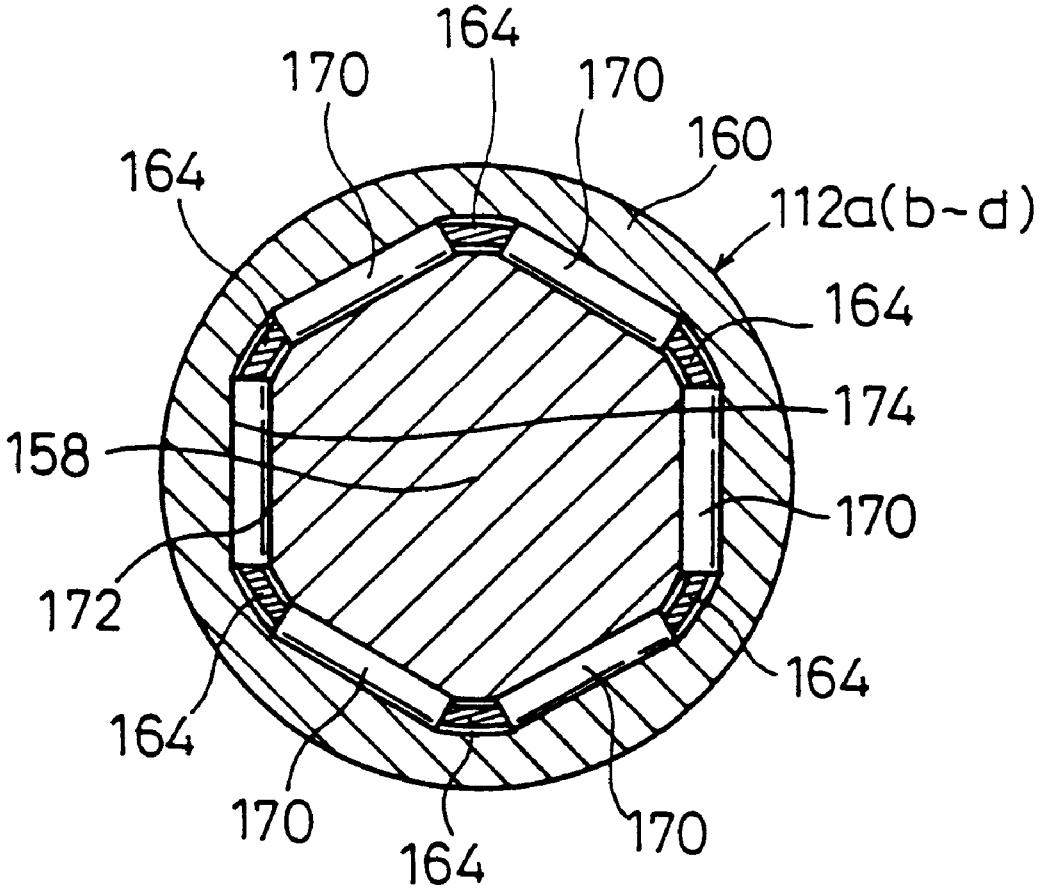
FIG. 6 shows a cross-sectional view taken along a line VI—VI shown in FIG. 5.

A plurality of arrays of holes 168 are formed substantially in parallel to one another along the axial direction in the guide ring 164. Rolling members 170 each having a substantially columnar configuration are rollably arranged in the holes 168. As shown in FIG. 6, first rolling surfaces 172 each having a flat configuration, which extend along the axial direction and which are formed in a plurality of arrays substantially in parallel to one another, are formed on the outer circumferential surface of the main post body 158. On the other hand, second rolling surfaces 174 each having a flat configuration opposing to the first rolling surfaces 172 are formed on the inner wall surface of the cover member 160.

In this embodiment, the rolling members 170 roll in a state of making line-to-line contact with the first rolling surfaces 172 and the second rolling surfaces 174 respectively. Accordingly, the cover member 160 connected to the elevating member 150 and the guide ring 164 engaged with the cover member 160 are displaced in an integrated manner along the axial direction of the main post body 158.

Alternatively, the following arrangement may be also available. That is, the rolling member 170 is not provided in the hole 168 of the guide ring 164. The guide ring 164 is formed to surround the outer circumferential surface of the main post body 158. The guide ring 164 is formed to make relative sliding displacement while making line-to-line contact with the main post body 158.

The forging die apparatus 100 according to the first embodiment of the present invention is basically constructed as described above. Next, its operation, function, and effect will be explained. The following embodiment will be described as exemplified by a case in which an outer cup for constructing a constant velocity universal joint is formed as a forged product obtained by forging.

Figure 9:
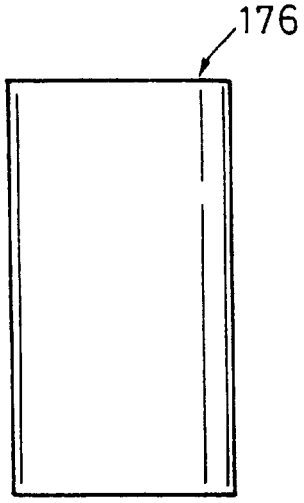
FIG. 9 shows a front view illustrating a columnar billet used to produce an outer cup for constructing a constant velocity universal joint.
Figure 10:
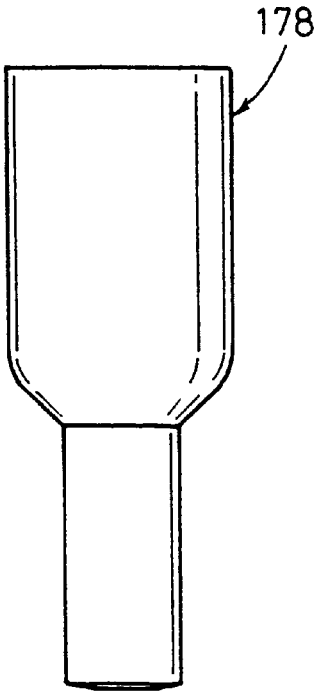
FIG. 10 shows a front view illustrating a primary formed product obtained by applying primary forging to the billet shown in FIG. 9.
Figure 11:
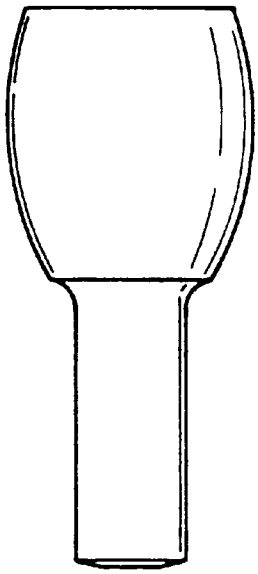
FIG. 11 shows a front view illustrating a preform obtained by applying preforming to the primary formed product shown in FIG. 10.

A primary formed product 178, which has different diameters respectively with an intermediate step section as shown in FIG. 10, is obtained by applying primary forging to a columnar billet 176 as shown in FIG. 9 by using an unillustrated die apparatus. Subsequently, the primary formed product 178 is subjected to preforming (see FIG. 11), followed by secondary forging by using another unillustrated die apparatus to obtain the secondary formed product 148 comprising a cup 180 and shaft 182 as shown in FIG. 12.

The forging die apparatus 100 according to the embodiment of the present invention further applies tertiary forging to the secondary forged product 148 as the forging material.

At first, a preparatory operation is performed in a state in which the punch 130 externally fitted with the cylindrical member 154 is inserted into the hole 132 of the first ring member 134. In this state, the upper die 126, the lower die 128, the sleeve 124, the forcible insertion ring 120, and other components are integrally assembled as described later on. Thus, the punch 130 is positioned with respect to the cavity 142 formed by the upper die 126 and the lower die 128.

The secondary formed product 148 as the forging material is charged in the cavity 142 in a state in which the punch 130 is arranged at an unillustrated lifted position. The punch 130 is lowered integrally with the elevating member 150 connected to the ram 36 in accordance with the driving action of the mechanical press 31 to give the state as shown in FIG. 1. Thus, the forging is started.

When the punch 130 is lowered integrally with the elevating member 150, any unbalanced load in the lateral direction is appropriately absorbed by the plurality of (for example, four of) guide means 112*a* to 112*d* provided between the elevating member 150 and the first die holder 114. Accordingly, the punch 130 is smoothly inserted under pressure toward the center of the first ring member 134.

When the forging is started, the cylindrical member 154, which is externally fitted to the part of the outer circumferential surface of the punch 130, proceeds in accordance with the guiding action of the annular groove 138 formed at the upper end of the hole 132 of the first ring member 134 (see FIG. 7). The punch 130 is further lowered, and thus the punch 130 and the cylindrical member 154 are integrally displaced in a state of being forcibly inserted into the hole 132 of the first ring member 134.

Figure 2:
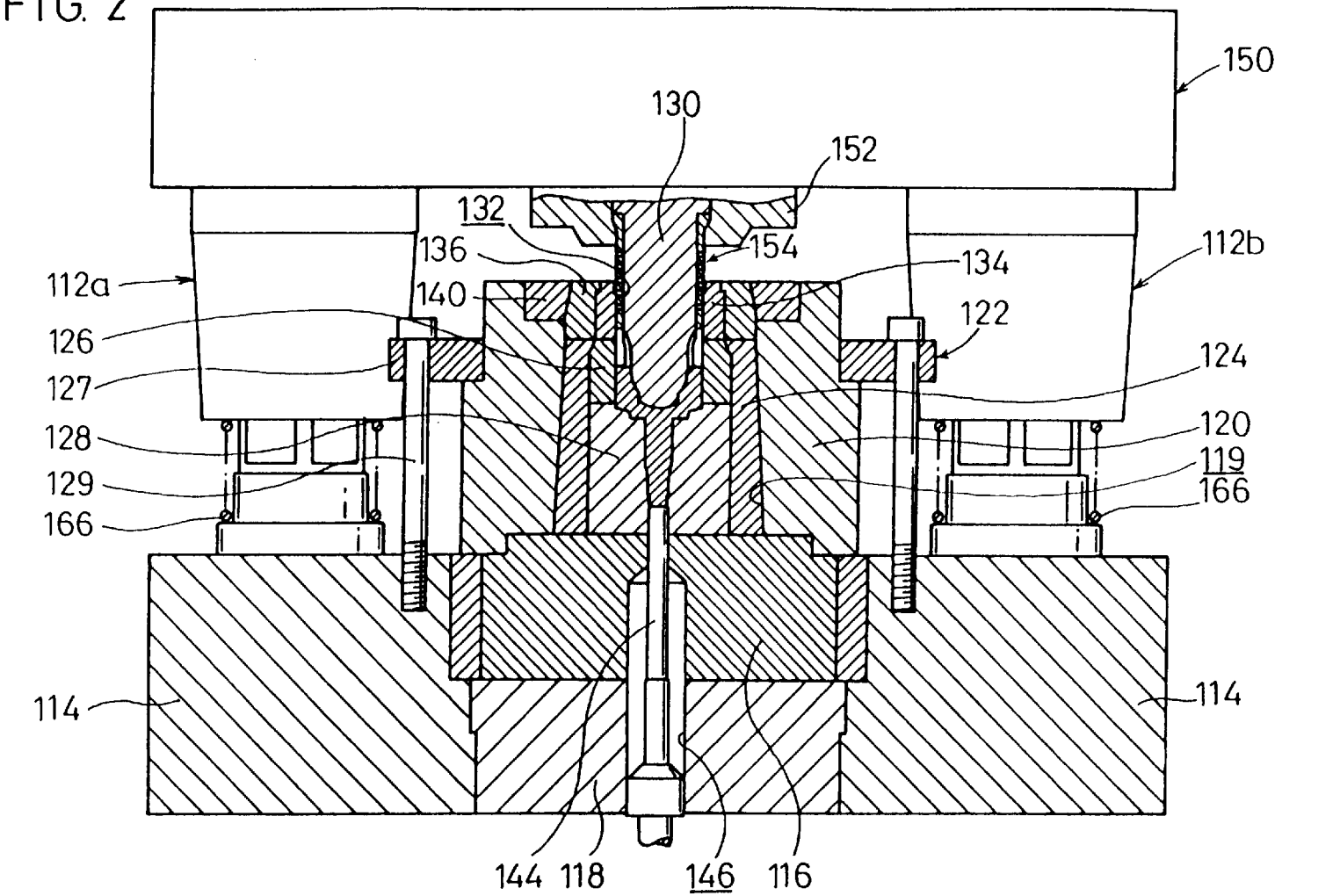
FIG. 2 illustrates an operation depicting a state in which a punch is lowered from a forging start position shown in FIG. 1, and the forging is completed.

The punch 130 is lowered as described above, and it arrives at the forging end position shown in FIG. 2 from the forging start position shown in FIG. 1. Accordingly, the forging material is forged by the aid of the punch 130, the lower die 128, and the upper die 126. The forging material causes plastic flow in conformity with the shape of the cavity 142.

After the forging is completed as described above, the punch 130 is lifted to the predetermined position integrally with the elevating member 150 connected to the ram 36 in accordance with the driving action of the mechanical press 31. Accordingly, the punch 130 and the cylindrical member 154 are separated from the hole 132 of the first ring member 134 to give a waiting state for the next step. The forged product 184 (see FIG. 13) is taken out in accordance with the displacement action of the knockout pin 144.

In the embodiment of the present invention, when the pressurizing force is applied to the forging material, the cylindrical member 154, which is externally fitted to the punch 130, is in the state of being forcibly inserted into the hole 132 of the first ring member 134. The punch 130 is lowered while maintaining the forcibly inserted state.

Figure 13:
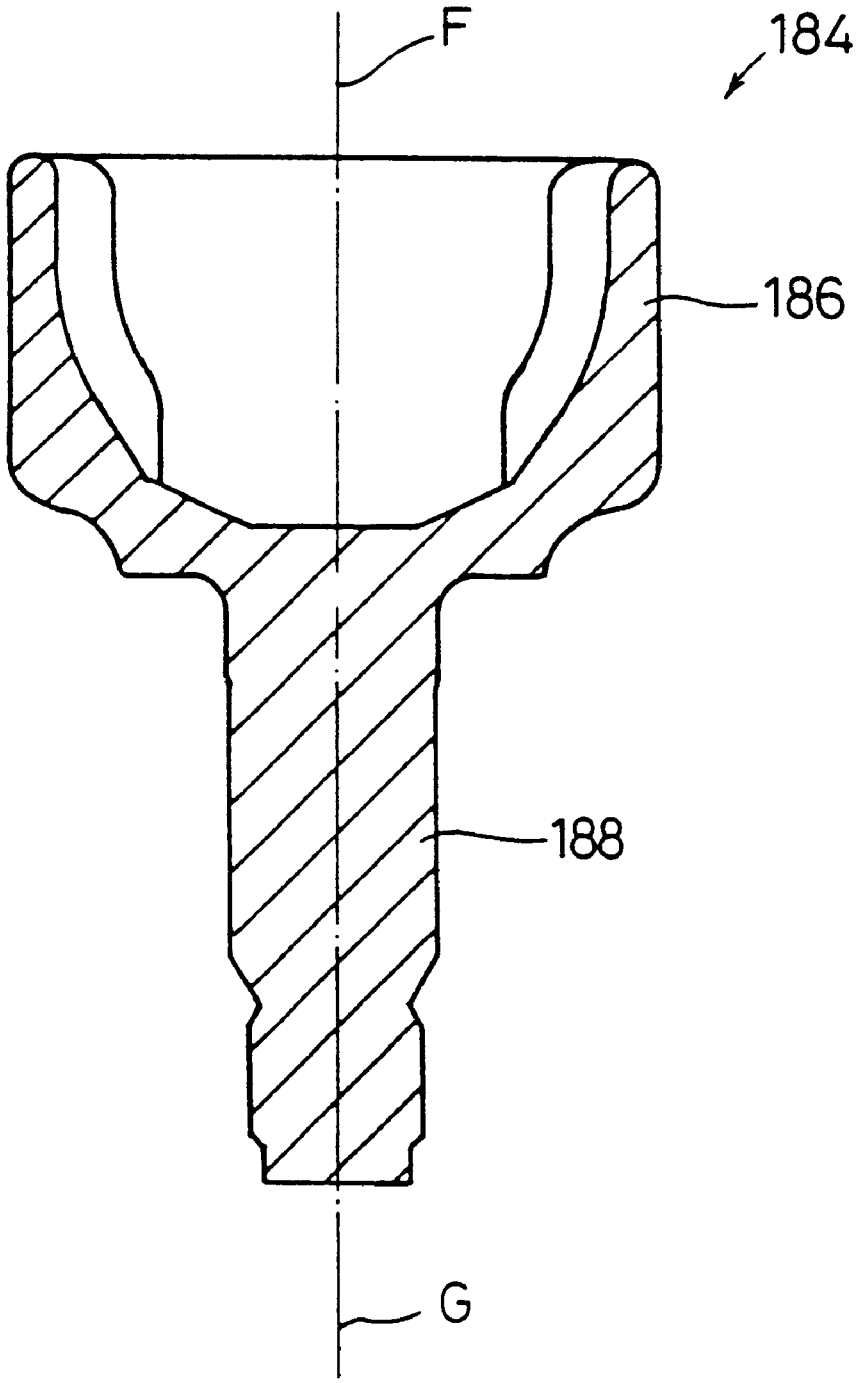
FIG. 13 shows a longitudinal sectional view illustrating a forged product obtained by using the forging die apparatus shown in FIG. 1.

Therefore, in the embodiment of the present invention, the pressurizing force is applied to the forging material in the state in which the punch 130 is forcibly inserted into the hole 132 of the first ring member 134 by the aid of the cylindrical member 154, and the punch 130 does not cause any centering deviation in the lateral direction. Accordingly, as shown in FIG. 13, it is possible to highly accurately maintain the coaxial degree between the axis F of the cup 186 and the axis G of the shaft 188 of the outer cup obtained as the forged product 184. In this embodiment, the deflection of the shaft 188 of the outer cup can be suppressed to be, for example, not more than 0.06 mm.

Further, the cylindrical member 154 and the first ring member 134 are formed of metal materials which are different from each other. Moreover, the lubricating characteristic is appropriately maintained by the aid of the graphite 156 embedded in the cylindrical member 154. Thus, it is possible to suppress occurrence of scuffing on the sliding surfaces of the cylindrical member 154 and the first ring member 134.

The cylindrical member 154 is detachably attached to the punch 130 by the aid of the jig 152. Therefore, an advantage is obtained in that the cylindrical member 154 can be conveniently exchanged with another new cylindrical member 154.

Additionally, for example, an advantage is obtained in that the outer circumferential surface of the cup 186 of the outer cup as an attachment site for a pulser (not shown) can be directly subjected to grinding.

Next, explanation will be made for an assembling step for the dies for constructing the forging die apparatus 100.

As shown in FIG. 14, at first, the inclined surface 121 of the sleeve 124 is disposed on the lower side. In this state, the upper die 126 and the lower die 128 are installed to the hole of the sleeve 124. In this embodiment, the inner circumferential surface of the sleeve 124 is set to be separated by the predetermined clearance 123 from the outer circumferential surfaces of the upper die 126 and the lower die 128, except for the inclined surface 121 for holding the upper die 126. A lubricant is applied to the outer circumferential surface of the sleeve 124, and the inner circumferential surface of the sleeve 124 is degreased beforehand to give an unlubricated condition.

Subsequently, as shown in FIG. 14, the upper surface and the lower surface of the forcible insertion ring 120 are disposed upside down so that the portion of the hole 119 having the larger diameter is arranged upward. In this state, the sleeve 124 involving the upper die 126 and the lower die 128 is inserted under pressure in the direction indicated by arrows along the hole 119 of the forcible insertion ring 120. In this procedure, the sleeve 124 is smoothly inserted under pressure along the hole 119 of the forcible insertion ring 120 in accordance with the lubricating action of the lubricant applied to the outer circumferential surface of the sleeve 124.

Figure 15:
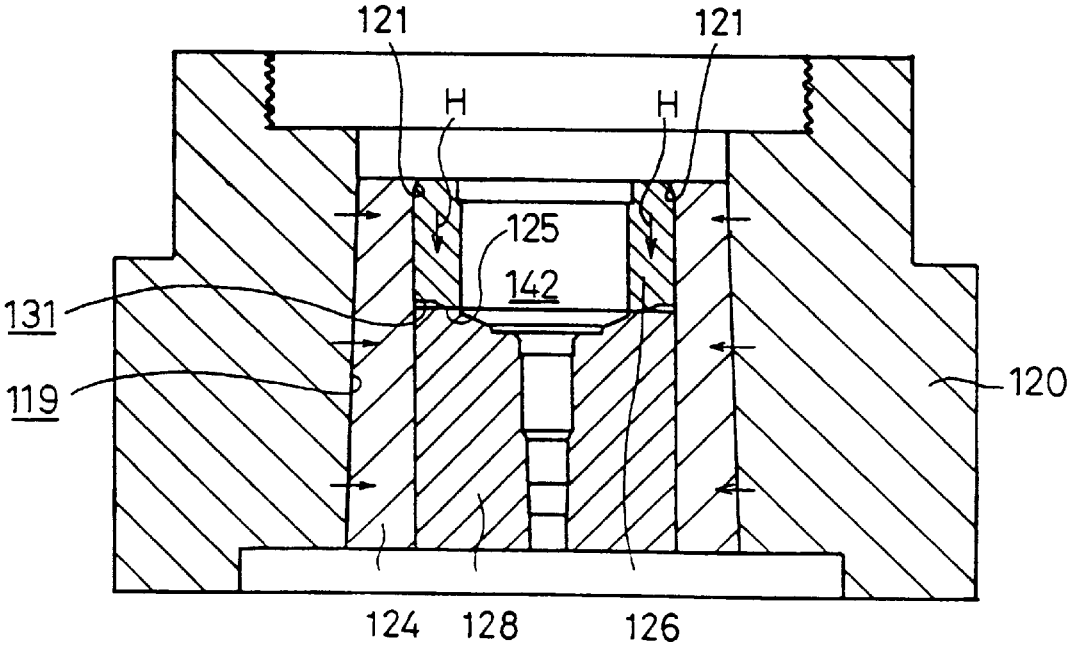
FIG. 15 shows a longitudinal sectional view illustrating a state in which the upper die, the lower die, and the sleeve are forcibly inserted into a hole of the forcible insertion ring.

After the sleeve 124, the upper die 126, and the lower die 128 are forcibly inserted into the hole 119, the forcible insertion ring 120 is inverted upside down to give a state shown in FIG. 15. In this embodiment, as shown in FIG. 15, the pressing force is exerted in the downward direction (in the direction of the arrow H) by the aid of the inclined surface 121 of the sleeve 124. The pressing force increases the surface pressure at the joining surface between the upper die 126 and the lower die 128.

Further, the forcible insertion of the sleeve 124 into the tapered hole 119 allows the compressive stress to act so that the sleeve 124 is tightened in the direction directed toward the center. The clearance 123 disappears between the inner circumferential surface of the sleeve 124 and the outer circumferential surfaces of the upper die 126 and the lower die 128 which are in the unlubricated condition. Thus, a state is given, in which the inner circumferential surface of the sleeve 124 makes mutual surface-to-surface contact with the outer circumferential surfaces of the upper die 126 and the lower die 128.

Therefore, the tightening force acts to make mutual tight surface-to-surface contact between the inner circumferential surface of the sleeve 124 and the outer circumferential surfaces of the upper die 126 and the lower die 128 in accordance with the action of the compressive stress. Thus, the joined state of the upper die 126 and the lower die 128 is locked. Accordingly, the upper die 126 and the lower die 128 are held in a state in which the surface pressure at the joining surface is increased.

As described above, in the embodiment of the present invention, the upper die 126 and the lower die 128 are maintained in the state in which the surface pressure at the joining surface is increased. Thus, it is possible to avoid occurrence of burr at the joining surface between the upper die 126 and the lower die 128, and it is possible to highly accurately maintain the coaxial degree between the upper die 126 and the lower die 128. Therefore, as shown in FIG. 13, it is possible to highly accurately maintain the coaxial degree between the axis F of the outer cup 186 and the axis G of the shaft 188 of the outer cup obtained as the forged product 184.

Figure 16:
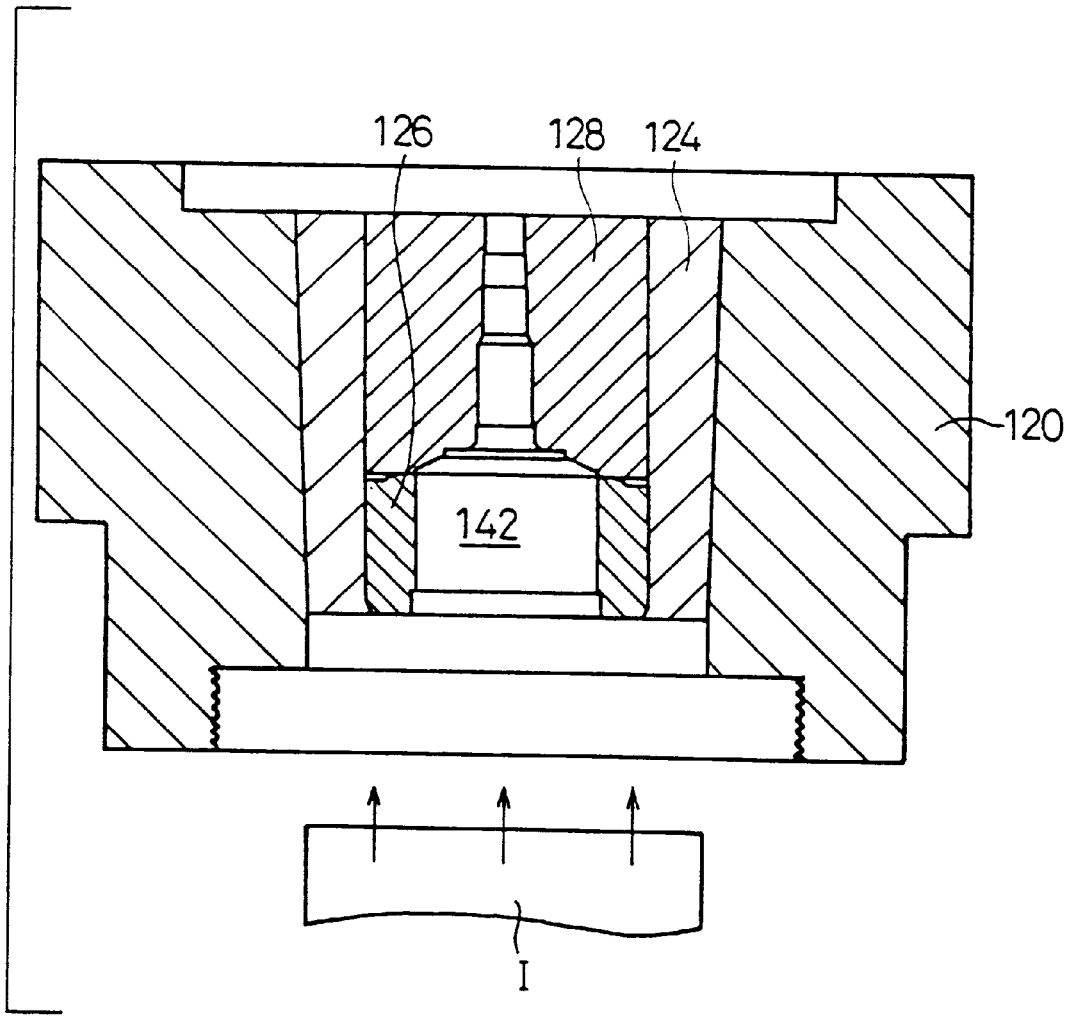
FIG. 16 shows a longitudinal sectional view illustrating a state in which the upper die and the lower die forcibly inserted into the hole of the forcible insertion ring are taken out.

As shown in FIG. 16, the upper die 126, the lower die 128, and the sleeve 124, which are forcibly inserted into the hole 119 of the forcible insertion ring 120, are pressed in the direction indicated by arrows by using a press apparatus I. By doing so, the upper die 126, the lower die 128, and the sleeve 124 can be taken out of the forcible insertion ring 120, and they can be exchanged with ease. As a result, it is possible to efficiently perform maintenance and improve the versatility. Further, it is possible to reduce the management cost for the die.

Figure 17:
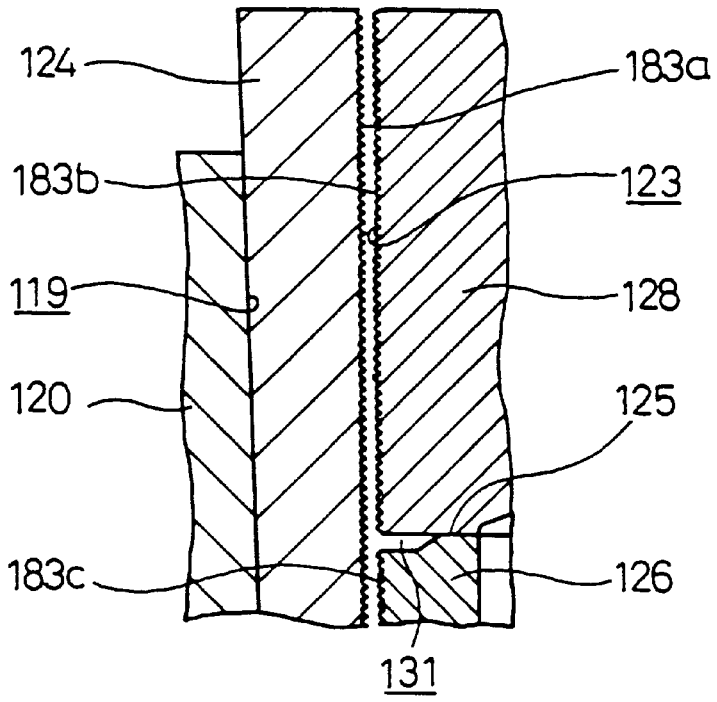
FIG. 17 shows a partial longitudinal sectional view illustrating a state before forcible insertion in which concave-convex portions are formed on an inner circumferential surface of the hole of the sleeve and on outer circumferential surfaces of the upper die and the lower die respectively.
Figure 18:
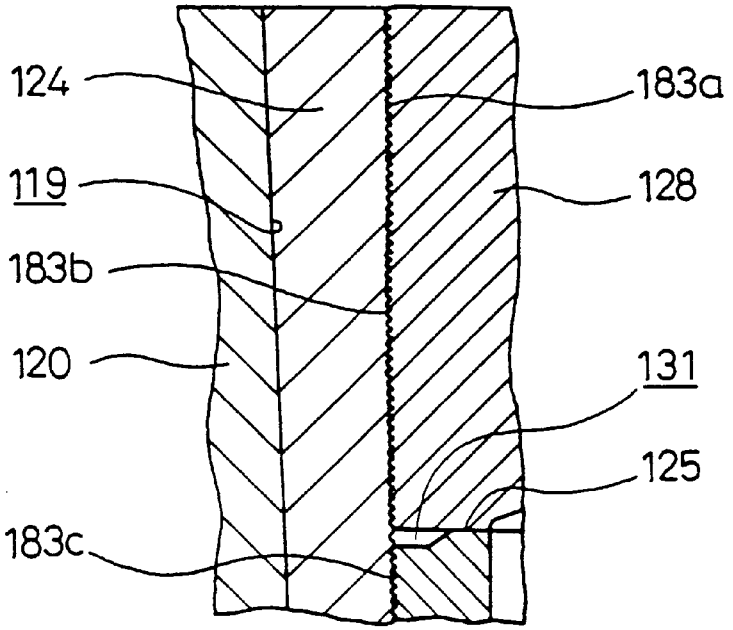
FIG. 18 shows a partial longitudinal sectional view illustrating a state after forcible insertion in which the upper die and the lower die are forcibly inserted into the hole of the sleeve.

As shown in FIG. 17, a convex-concave portion (or concave-convex portion) 183*a* is formed on the inner circumferential surface of the sleeve 124 which makes mutual surface-to-surface contact, for example, by means of lace processing. Concave-convex portions (or convex-concave portions) 183*b*, 183*c* are formed on the outer circumferential surfaces of the upper die 126 and the lower die 128 respectively. Accordingly, the frictional force upon the surface-to-surface contact is increased. Thus, it is possible to more tightly lock the joined state of the upper die 126 and the lower die 128 (see FIG. 18).

Subsequently, the first ring member 134 and the second ring member 136 are arranged on the upper die 126 and the sleeve 124 respectively. The clamping ring 140 is screwed along the screw hole 139 of the forcible insertion ring 120. Thus, the first ring member 134 and the second ring member 136 are integrally assembled with the upper die 126, the lower die 128, and other components in accordance with the tightening action of the tapered section 141 of the clamping ring 140 (see FIG. 3). Thus, the die-assembling step is completed.

Figure 19:
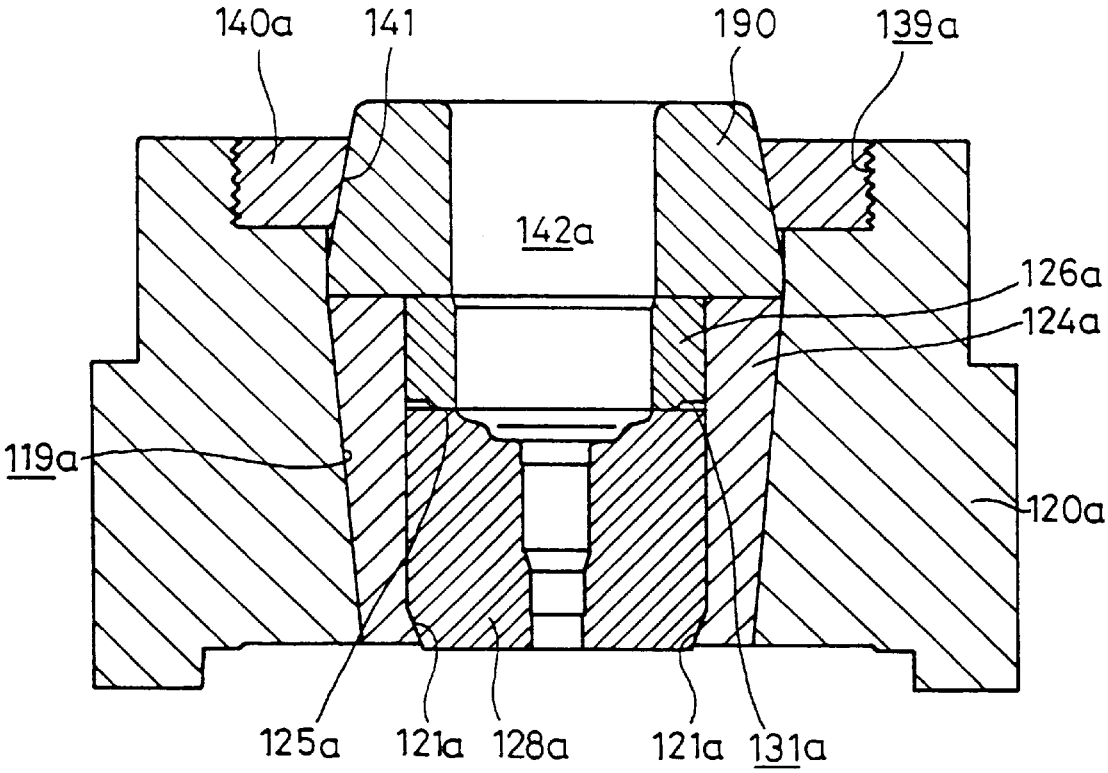
FIG. 19 shows a longitudinal sectional view illustrating a modified embodiment of the die shown in FIG. 3.

FIG. 19 shows a modified embodiment of the die shown in FIG. 3. Explanation will be made below, while constitutive components or parts corresponding to those shown in FIG. 3 are designated by the same reference numerals but affixed with a symbol "a".

As clearly understood from FIG. 19, a hole 119*a* of a forcible insertion ring 120*a* is formed to have a tapered configuration in which its diameter is gradually reduced from its top toward its bottom in an assembled state. The outer circumferential surface of a sleeve 124*a* is formed corresponding to the hole 119*a*. A tapered inclined surface 121*a*, which has its diameter gradually reduced toward the lower end edge, is formed at a lower portion of the inner circumferential surface of the sleeve 124*a*. Reference numeral 190 indicates a ring member as obtained by integrally forming the first ring member 134 and the second ring member 136 shown in FIG. 3.

In the embodiment shown in FIG. 19, the inclined surface 121*a*, which is formed on the sleeve 124*a*, exerts the force to press the lower die 128*a* in the upward direction in the assembled state. Thus, the inclined surface 121*a* functions to prevent the lower die 128*a* from disengagement from the sleeve 124*a*. The ring member 190 is pressed in the downward direction by a tapered section 141*a* in accordance with the action of a clamping ring 140*a* screwed into a screw hole 139*a*. The pressing force in the downward direction is applied to an upper die 126*a*. Thus, the surface pressure at the contact surface between the upper die 126*a* and the lower die 128*a* is increased.

The modified embodiment shown in FIG. 19 constructed as described above has the following advantage. That is, the lower die 128*a* is prevented from disengagement in the downward direction when the forging is continuously carried out. The surface pressure at the contact surface between the upper die 126*a* and the lower die 128*a* can be arbitrarily set within an allowable range of the die material in accordance with the pressing action of the ring member 190.

Figure 20:
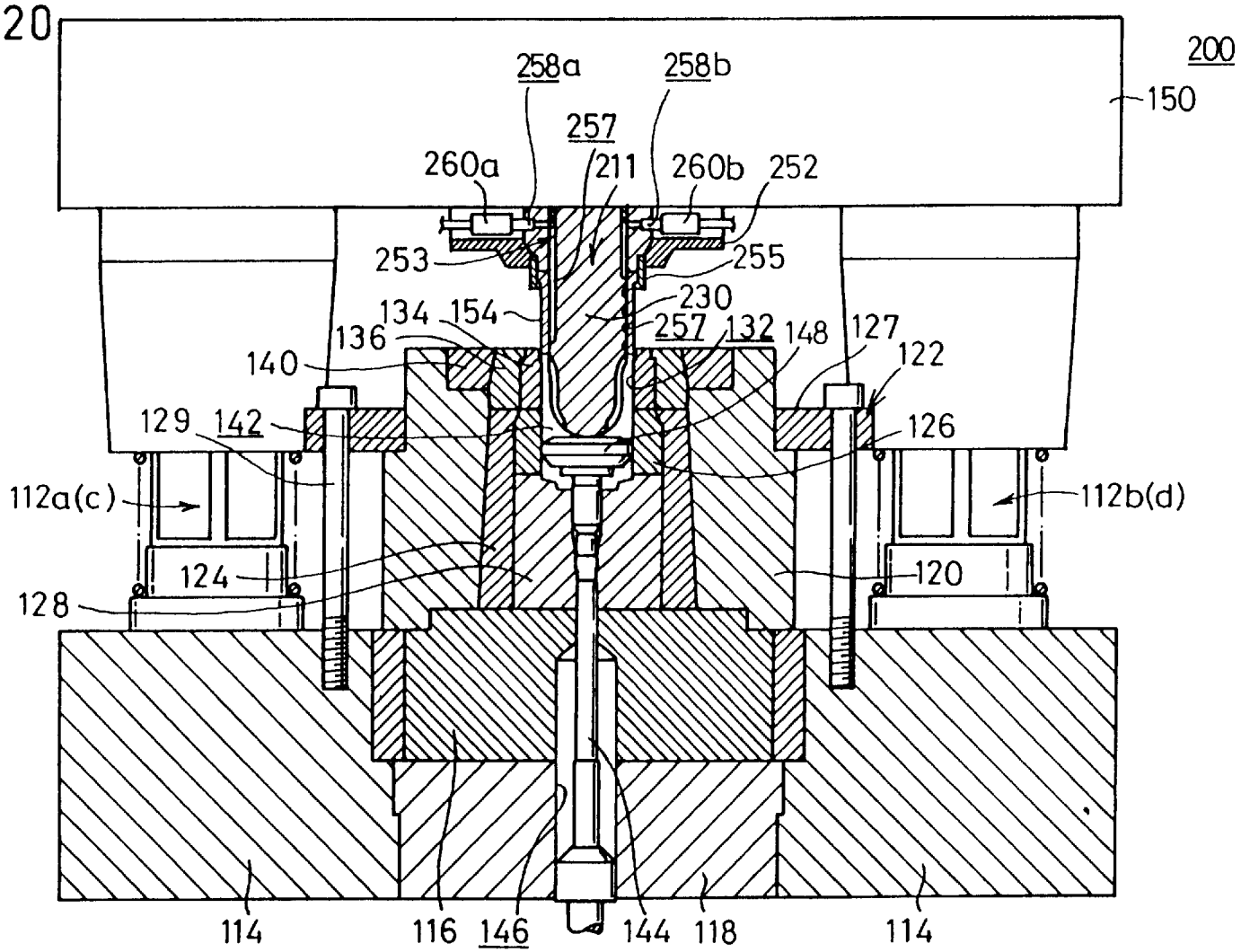
FIG. 20 shows a longitudinal sectional view illustrating a forging die apparatus according to a second embodiment of the present invention.

Next, a forging die apparatus 200 according to a second embodiment is shown in FIG. 20. In the following embodiment, the same constitutive components as those of the first embodiment are designated by the same reference numerals, detailed explanation of which will be omitted.

The forging die apparatus 200 comprises a forging punch unit 211 fixed to the bottom surface of the elevating member 150 by the aid of a holder 252. The forging punch unit 211 is provided displaceably along the vertical direction integrally with the elevating member 150 in accordance with the guiding action of the plurality of guide means 112*a* to 112*d* provided vertically on the first die holder 114.

Figure 22:
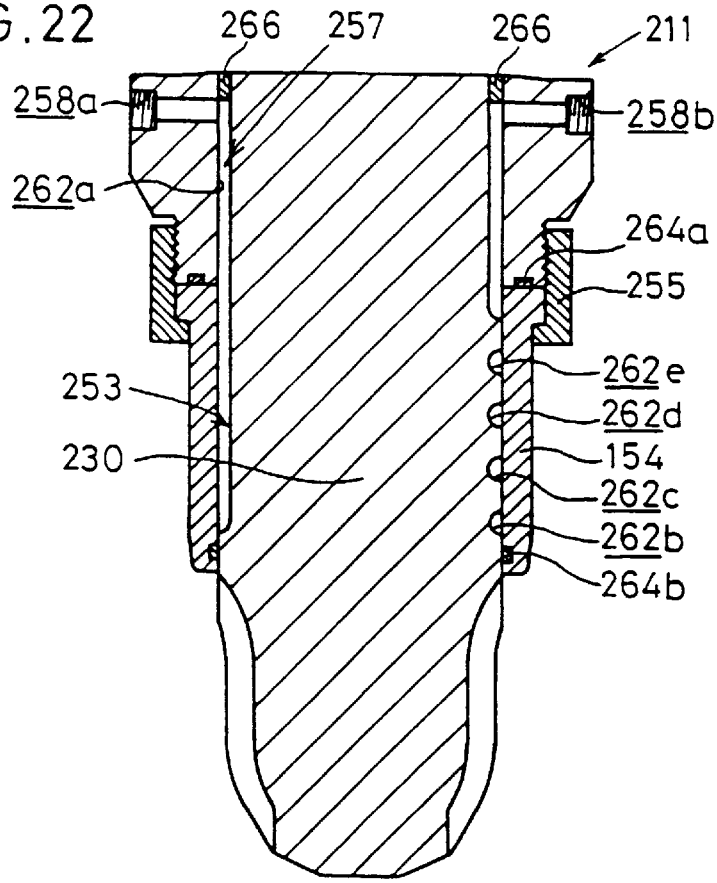
FIG. 22 shows a longitudinal sectional view illustrating a forging punch unit shown in FIG. 20.

As shown in FIG. 22, the forging punch unit 211 comprises a main punch body 230 fixed to the bottom surface of the elevating member 150 by the aid of the holder 252, a cooling means 253 for cooling the main punch body 230 to have a predetermined temperature, and a cylindrical member 154 formed of a cylindrical metal material externally fitted to a predetermined portion of the outer circumference of the main punch body 230.

The cylindrical member 154 is held detachably by the aid of a lock ring 255 which engages with a step section of the cylindrical member 154 and which is screwed into a screw portion of the main punch body 230. As shown in FIG. 8, the lubricating characteristic can be appropriately maintained when the cylindrical member 154 is forcibly inserted into the hole 132 of the first ring member 134, by embedding the graphite 156 in the plurality of holes formed on the outer circumferential surface of the cylindrical member 154. In this embodiment, the diameter on the outer circumferential side of the cylindrical member 154 externally fitted to the main punch body 230 is set to be slightly larger than the diameter on the inner circumferential side of the hole 132 of the first ring member 134.

As shown in FIG. 22, the cooling means 253 is formed between the cylindrical member 154 and the main punch body 230, and it comprises a communication passage 257 for allowing a cooling medium to flow therethrough. The communication passage 257 is formed to communicate with a cooling medium supply port 258*a* and a cooling medium discharge port 258*b* which are formed on the main punch body 230. Those usable as the cooling medium include, for example, cooling liquid, water, air, and gas.

As shown in FIG. 20, the cooling medium supply port 258*a* and the cooling medium discharge port 258*b* are connected to tube joints 260*a*, 260*b* arranged for the holder 252 respectively. The cooling medium is supplied from an unillustrated cooling medium supply source via tubes (not shown) connected to the tube joints 260*a*, 260*b*.

Figure 23:
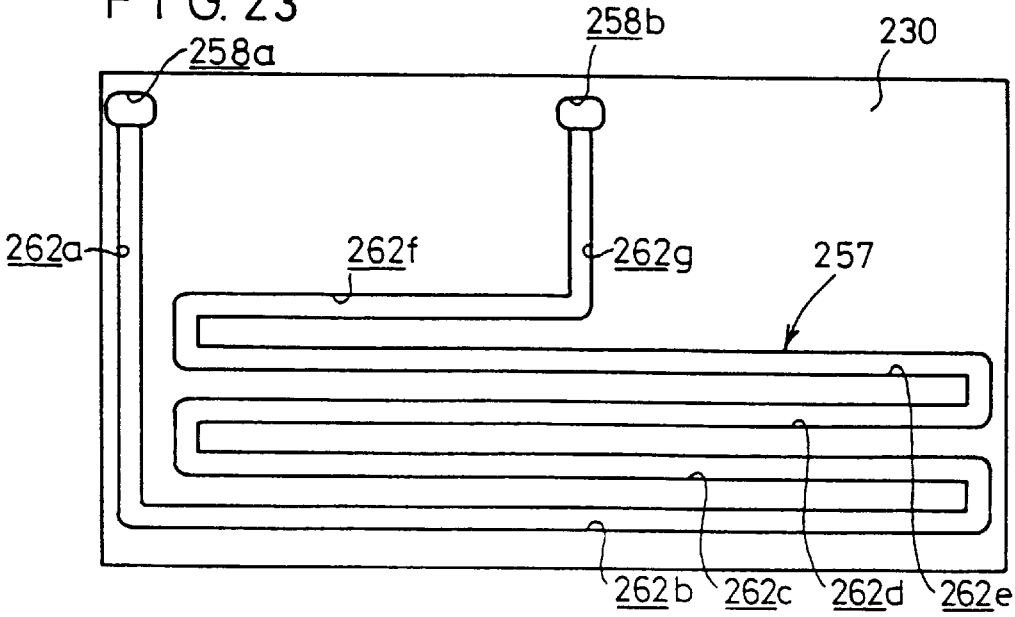
FIG. 23 shows, in a planar form, an outer circumferential surface of the main punch body for illustrating passages formed on the main punch body shown in FIG. 22.

As shown in FIGS. 22 and 23, the communication passage 257 comprises a first passage 262*a* which is formed between the cylindrical member 154 and the main punch body 230, which communicates with the cooling medium supply port 258*a*, and which descends along the axial direction of the main punch body 230, a second passage 262*b* which is bent from the first passage 262*a* and which is circumscribed along the outer circumference of the main punch body 230, a third passage 262*c* which is bend upwardly from the second passage 262*b* and which is circumscribed substantially in parallel to the second passage 262*b*, a fourth passage 262*d* which is bend upwardly from the third passage 262*c* and which is circumscribed substantially in parallel to the third passage 262*c*, a fifth passage 262*e* which is bend upwardly from the fourth passage 262*d* and which is circumscribed substantially in parallel to the fourth passage 262*d*, a sixth passage 262*f* which is bend upwardly from the fifth passage 262*e* and which is circumscribed substantially in parallel to the fifth passage 262*e*, and a seventh passage 262*g* which is bent upwardly from the sixth passage 262*f* and which communicates with the cooling medium discharge port 258*b*.

In this embodiment, each of the first to seventh passages 262*a* to 262*g* is substantially composed of a groove having a circular arc-shaped cross section formed on the outer circumferential surface of the main punch body 230. The first to seventh passages 262*a* to 262*g* are formed to make communication with each other. Reference numerals 264*a*, 264*b* indicate seal rings for holding the communication passage 257 in an air-tight manner or in a liquid-tight manner. Reference numeral 266 indicates blank caps for closing ends of the first passage 262*a* and the seventh passage 262*g*.

The forging die apparatus 200 according to the second embodiment of the present invention is basically constructed as described above. Next, its operation, function, and effect will be explained.

As a preparatory operation, the cooling medium supply source (not shown) is energized beforehand to previously supply the cooling medium via the unillustrated tube to the communication passage 257 formed between the cylindrical member 154 and the main punch body 230.

The secondary formed product 148 (see FIG. 12) as the forging material is charged in the cavity 142 in a state in which the main punch body 230 is arranged at an unillustrated lifted position. The main punch body 230 is lowered integrally with the elevating member 150 connected to the ram 36 in accordance with the driving action of the mechanical press 31 to give the state shown in FIG. 20. Thus, the forging is started.

When the main punch body 230 is lowered integrally with the elevating member 150, any unbalanced load in the lateral direction is appropriately absorbed by the plurality of (for example, four of) guide means 112*a* to 112*d* (see FIG. 4) provided between the elevating member 150 and the first die holder 114. Accordingly, the main punch body 230 is smoothly inserted under pressure toward the center of the first ring member 134 by the aid of the cylindrical member 154.

When the forging is started, the cylindrical member 154, which is externally fitted to the part of the outer circumferential surface of the main punch body 230, proceeds in accordance with the guiding action of the annular groove 138 formed at the upper end of the hole 132 of the first ring member 134. The main punch body 230 is further lowered, and thus the main punch body 230 and the cylindrical member 154 are integrally displaced in a state of being forcibly inserted into the hole 132 of the first ring member 134.

Figure 21:
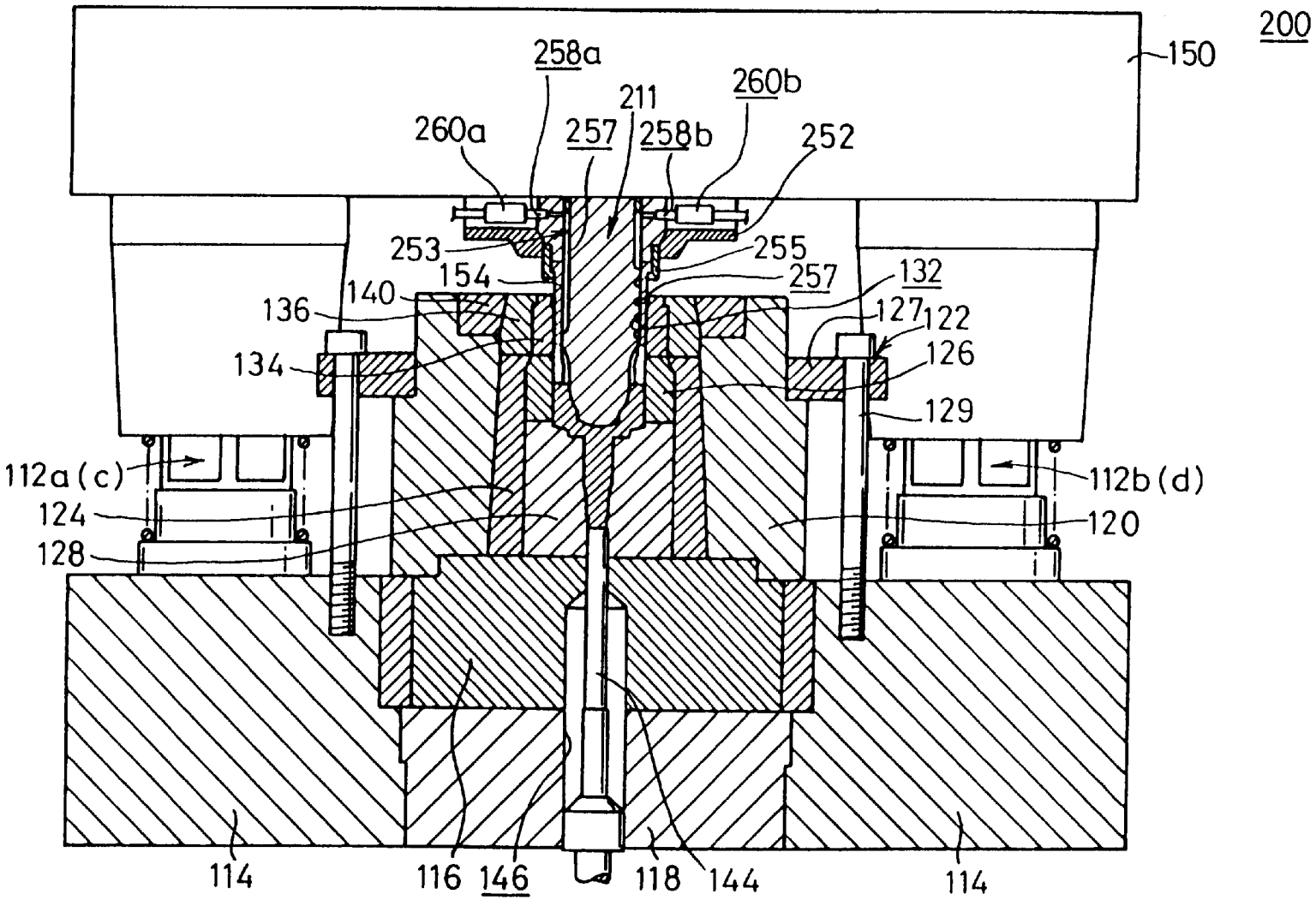
FIG. 21 illustrates an operation depicting a state in which a main punch body is lowered from a forging start position shown in FIG. 20, and the forging is completed.

The main punch body 230 is lowered as described above, and it arrives at the forging end position shown in FIG. 21 from the forging start position shown in FIG. 20. Accordingly, the secondary formed product 148 as the forging material is forged by the aid of the main punch body 230, the lower die 128, and the upper die 126. The forging material causes plastic flow in conformity with the shape of the cavity 142.

In this embodiment, the main punch body 230 is directly cooled by the cooling medium flowing through the first to seventh passages 262*a* to 262*g* formed between the cylindrical member 154 and the main punch body 230. The frictional force, which is generated when the forging material is forged, can be appropriately absorbed owing to the cooling action exerted on the main punch body 230. Therefore, it is possible to suppress thermal expansion of the main punch body 230 which would be otherwise caused by the frictional heat. It is possible to further increase the durability of the main punch body 230.

The frictional heat, which is generated on the forcible insertion surface of the cylindrical member 154 forcibly inserted into the hole 132 of the first ring member 134, is also appropriately absorbed in accordance with the cooling action described above. Therefore, it is possible to improve the durability of the cylindrical member 154.

After the forging is completed as described above, the main punch body 230 is lifted to the predetermined position integrally with the elevating member 150 connected to the ram 36 in accordance with the driving action of the mechanical press 31. Accordingly, the main punch body 230 and the cylindrical member 154 are separated from the hole 132 of the first ring member 134 to give a waiting state for the next step. The forged product 184 (see FIG. 13) is taken out in accordance with the displacement action of the knockout pin 144.

Figure 24:
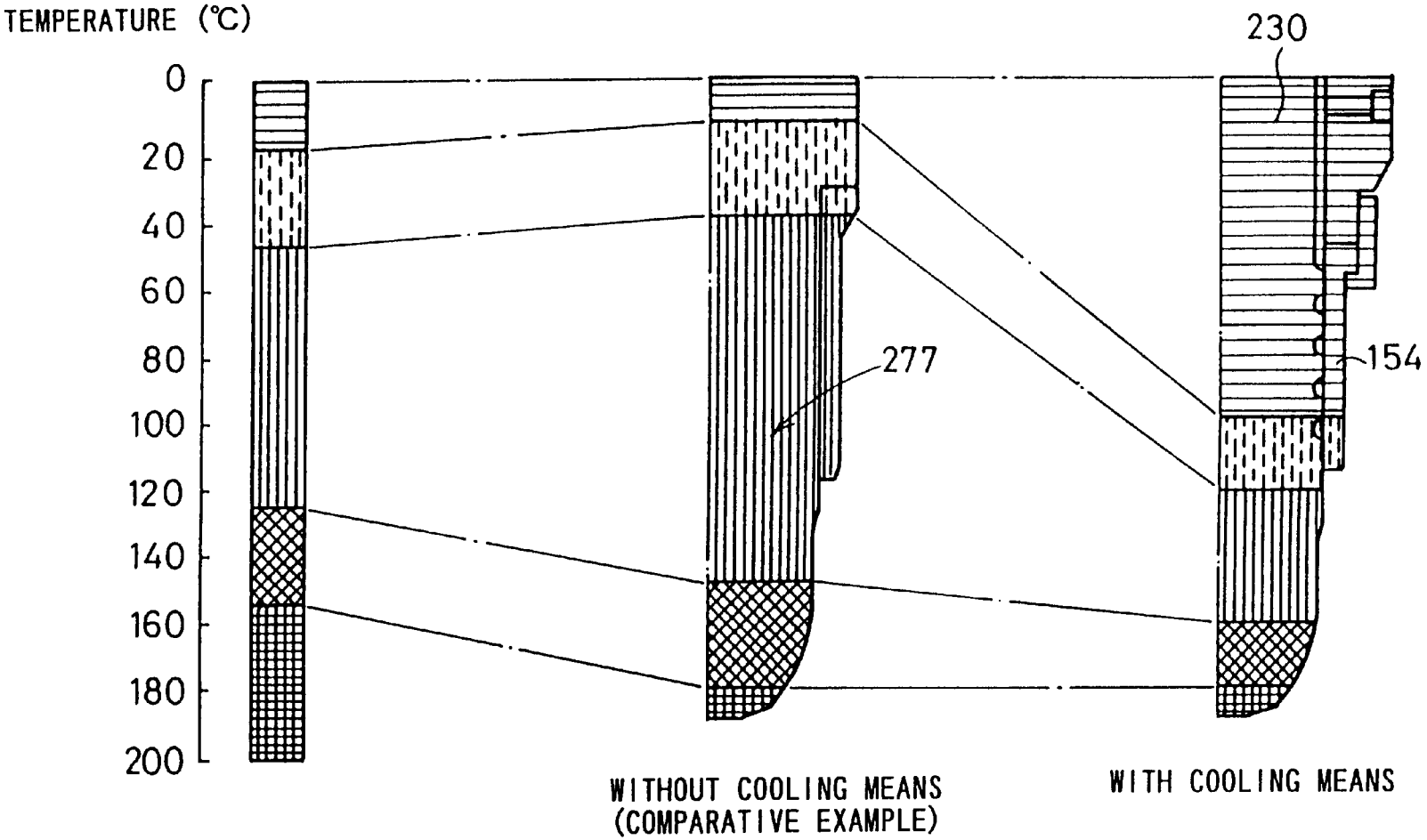
FIG. 24 illustrates temperature distributions in the main punch body shown in FIG. 22 and in a main punch body concerning a Comparative Example.

FIG. 24 shows temperature distributions caused by the forging heat when the forging is performed by using the main punch body 230 and the cylindrical member 154 provided with the cooling means 253, and using a main punch body 277 concerning Comparative Example not provided with,the cooling means 253 respectively. The cooling medium, which is used for the cooling means 253, is ordinary water. It is assumed that the frictional heat is not included in the forging heat.

As clearly understood from FIG. 24, it has been revealed that the main punch body 230 and the cylindrical member 154 provided with the cooling means 253 have a lot of portions which are at low temperatures, as compared with the main punch body 277 concerning Comparative Example not provided with the cooling means 253.

For example, in the case of the main punch body 230 and the cylindrical member 154 provided with the cooling means 253, the portion provided with the first to seventh passages 262*a* to 262*g* for allowing the cooling medium to flow therethrough is cooled to be not more than 20° C. On the contrary, the portion of the main punch body 277 corresponding to the foregoing portion has a relatively high temperature which is not more than 120° C.

Figure 25:
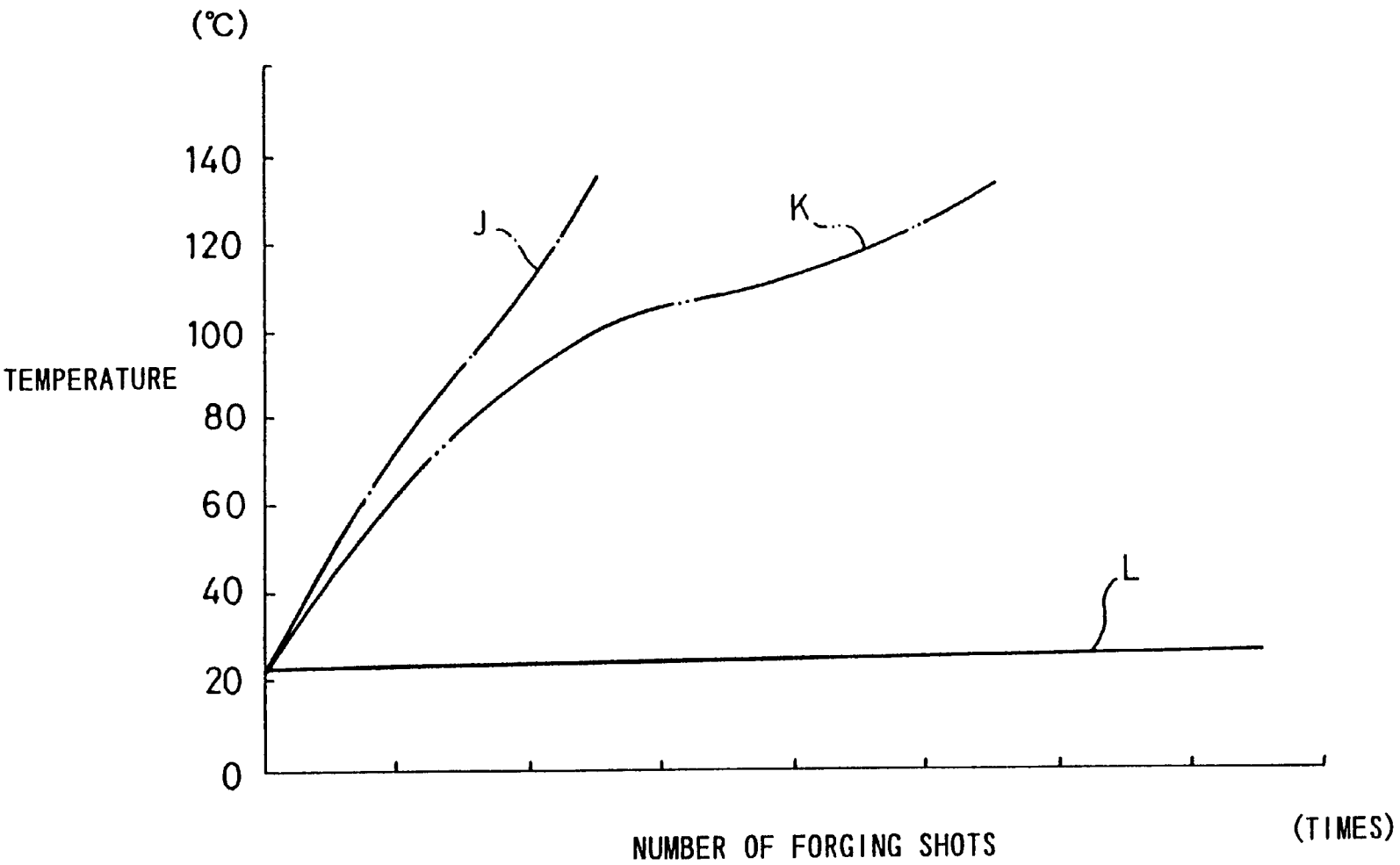
FIG. 25 illustrates a relationship between the number of shots and the temperature of the cylindrical member.

FIG. 25 shows the relationship between the temperature of the cylindrical member 154 and the number of forging shots. In FIG. 25, characteristic curves J and K represent cases in which the cylindrical member 154 not provided with the cooling means 253 is used, and a characteristic curve L represents a case in which the cylindrical member 154 provided with the cooling means 253 is used.

As for the cylindrical member 154 concerning the characteristic curve J, the forcible insertion margin for the first ring member 134 is set to be about 0.03 mm. As for the cylindrical member 154 concerning the characteristic curve K, the forcible insertion margin is set to be about 0.01 mm. As for the cylindrical member 154 concerning the characteristic curve L, the forcible insertion margin is set to be about 0.01 mm.

In the case of the cylindrical member 154 concerning the characteristic curve L provided with the cooling means 253, the increase in temperature is suppressed, and the temperature is maintained to be substantially constant at a low temperature (about 20° C.) even when the number of forging shots is increased. Therefore, no scorch occurs on the first ring member 134. On the contrary, in the case of the cylindrical members 154 concerning the characteristic curves J and K not provided with the cooling means 253, the temperature is increased in accordance with the increase in the number of forging shots, and scorch occurs on the cylindrical members 154.

As described above, in the embodiment of the present invention, the frictional heat generated by the forging material and the main punch body 230 is appropriately absorbed by the aid of the cooling means 253. Accordingly, the thermal expansion can be suppressed, and it is possible to further improve the durability of the main punch body 230.

Since the cooling means 253 is constructed by the simple mechanism, it is possible to respond to mass production.

Further, in the embodiment of the present invention, the pressurizing force is applied to the forging material in the state in which the main punch body 230 is forcibly inserted into the hole 132 of the first ring member 134 by the aid of the cylindrical member 154, and thus the main punch body 230 does not cause any centering deviation in the lateral direction. Accordingly, as shown in FIG. 13, it is possible to highly accurately maintain the coaxial accuracy between the axis F of the cup 186 and the axis G of the shaft 188 of the outer cup obtained as the forged product 184.

Furthermore, the cylindrical member 154 and the first ring member 134 are formed of metal materials which are different from each other. Moreover, the lubricating characteristic is appropriately maintained by the aid of the graphite 156 embedded in the cylindrical member 154. Thus, it is possible to suppress occurrence of scuffing on the sliding surfaces of the cylindrical member 154 and the first ring member 134.

Moreover, the cylindrical member 154 is detachably attached to the main punch body 230 by the aid of the lock ring 255. Therefore, an advantage is obtained in that the cylindrical member 154 can be conveniently exchanged with another new cylindrical member 154.

Figure 26:
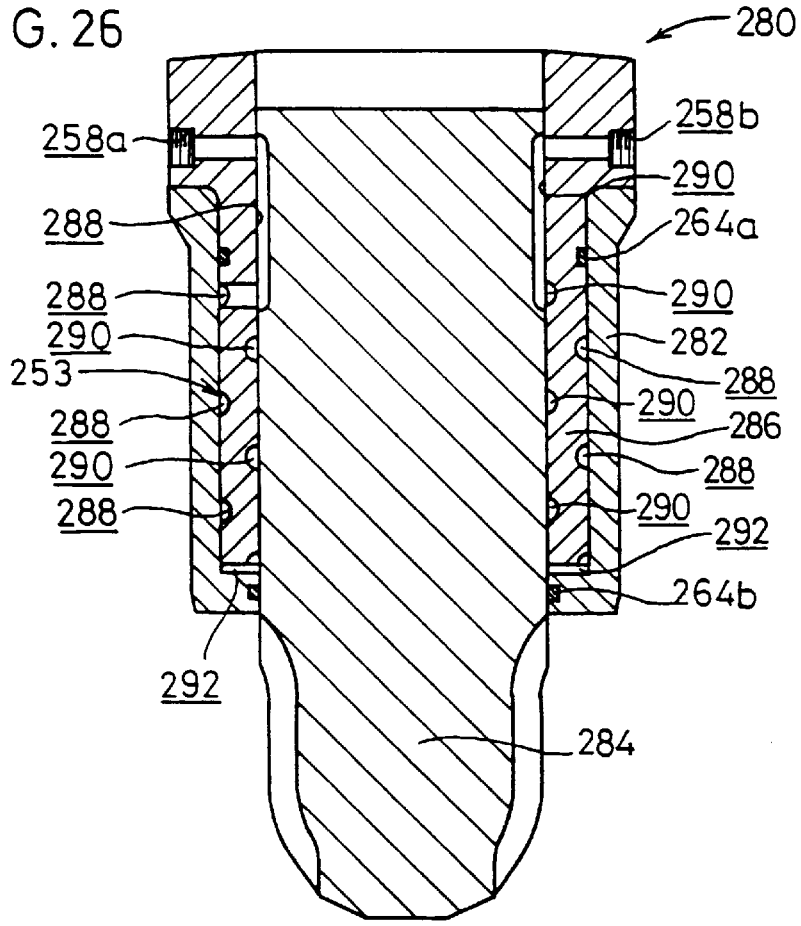
FIG. 26 shows a longitudinal sectional view illustrating a modified embodiment of the forging punch unit.
Figure 27:
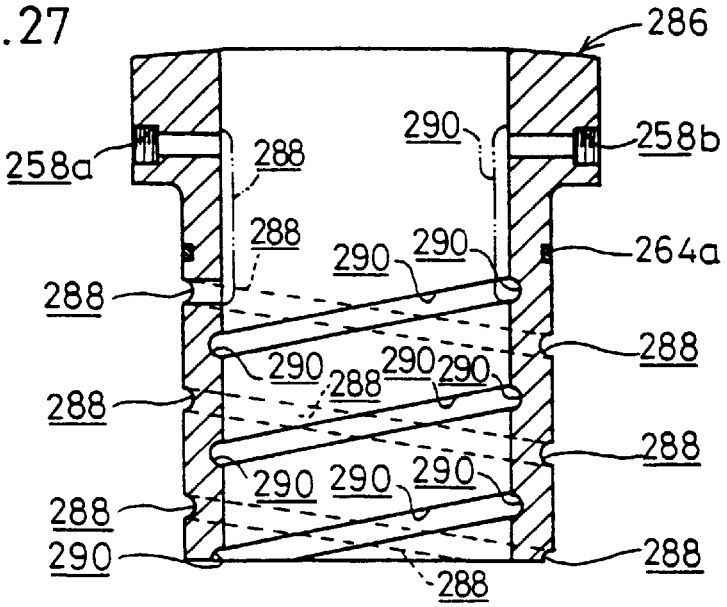
FIG. 27 illustrates communication passages formed on an intermediate member for constructing the forging punch unit shown in FIG. 26.

Next, a modified embodiment of the forging punch unit 211 according to the embodiment of the present invention is shown in FIGS. 26 and 27. The same constitutive components as those of the forging punch unit 211 shown in FIG. 22 are designated by the same reference numerals, detailed explanation of which will be omitted.

A forging punch unit 280 according to the modified embodiment is different from the forging punch unit 211 shown in FIG. 22 in that a substantially cylindrical intermediate member 286 is interposed between a cylindrical member 282 and a main punch unit 284, and a first communication passage 288 and a second communication passage 290 are formed between the cylindrical member 282 and the intermediate member 286 and between the main punch unit 284 and the intermediate member 286.

That is, a cooling medium supply port 258*a* and a cooling medium discharge port 258*b*, which are opposed to one another, are formed on the upper side of the intermediate member 286. A first communication passage 288, which communicates with the cooling medium supply port 258*a*, is formed to make circumscription in a helical configuration between the cylindrical member 282 and the intermediate member 286. Further, a second communication passage 290, which communicates with the cooling medium discharge port 258*b*, is formed to make circumscription in a helical configuration between the main punch body 284 and the intermediate member 286.

In this embodiment, as shown in FIG. 27, the first communication passage 288 and the second communication passage 290 are substantially composed of grooves having circular arc-shaped cross sections formed on the outer circumferential surface and the inner circumferential surface of the intermediate member 286 respectively. The first communication passage 288 and the second communication passage 290 are formed to make communication with each other via a space 292 (see FIG. 26) closed at the lower end of the intermediate member 286.

The structure, the function, and the effect of this embodiment other than the above are equivalent to those of the forging punch unit 211 shown in FIG. 22. Therefore, detailed explanation thereof is omitted.

Figure 28:
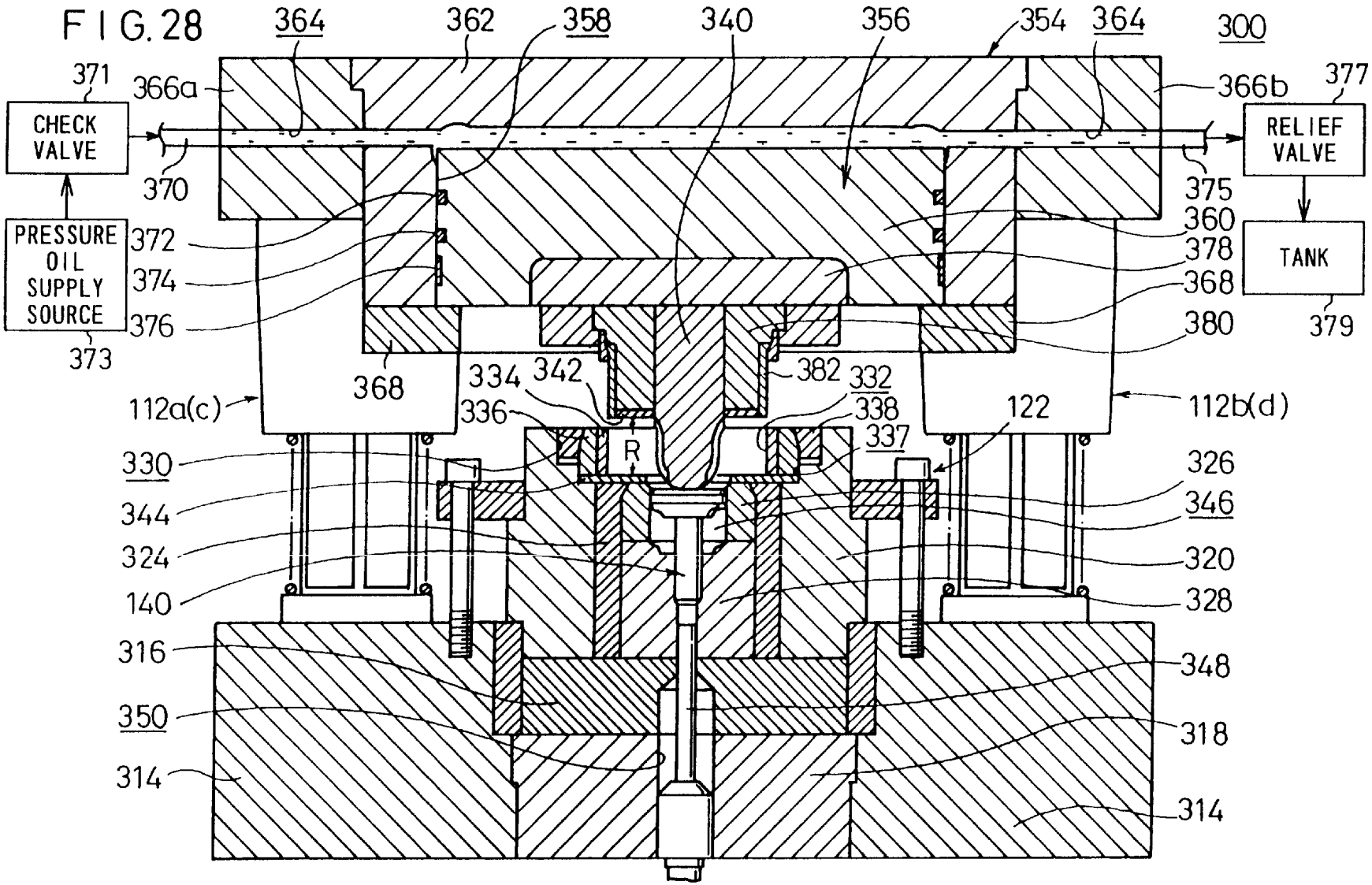
FIG. 28 shows a longitudinal sectional view illustrating a forging die apparatus according to a third embodiment of the present invention.

Next, a forging die apparatus 300 according to a third embodiment of the present invention is shown in FIG. 28.

The forging die apparatus 300 comprises a first die holder 314 on which a plurality of guide means 112*a* to 112*d* (see FIG. 4) are vertically provided in the close vicinity of four corners, and second and third die holders 316, 318 which are provided and stacked at the center of the first die holder 314.

A thick-walled forcible insertion ring 320, which is formed in an integrated manner, is fixed on the second die holder 316 by the aid of a clamping means 122. An upper die 326 and a lower die 328 are integrally joined in a hole of the forcible insertion ring 320 via a sleeve 324 which is formed to be thin-walled.

A first ring member 334 formed with a hole 332, a second ring member 336 externally fitted to the first ring member 334, and a clamping ring 338 for holding the first ring member 334 and the second ring member 336 are provided in an annular recess 330 formed at an upper portion of the forcible insertion ring 320. The first ring member 334 and the second ring member 336 are formed on the upper side of the forcible insertion ring 320, and they are inserted under a pressure into a hole 337 processed coaxially with a cavity 346 described later on, with a good coaxial degree. In this embodiment, the first ring member 334 and the second ring member 336 may be integrally formed as an unillustrated ring member without constructing them as the separate members respectively.

A first plate 344 for regulating the displacement amount of a punch 340 by making abutment against a second plate 342 which is displaceable integrally with the punch 340 as described later on is provided on upper surfaces of the upper die 326 and the sleeve 324.

The first ring member 334 is formed of, for example, a cemented carbide material, and it is in a state of being strongly tightened toward the center by the second ring member 336 which has been subjected to the shrinkage fitting treatment. The first ring member 334 and the second ring member 336 are forcibly inserted into the hole 337 processed coaxially with the cavity 346. Further, the first ring member 334 and the second ring member 336 are tightened by a tapered section of the clamping ring 338 which is screwed into a screw hole of the forcible insertion ring 320. Thus, the first ring member 334 and the second ring member 336 are integrally joined to the recess 330 of the forcible insertion ring 320 with a good coaxial degree with respect to the cavity 346.

In this embodiment, the cavity 346 is formed by the upper die 326 and the lower die 328. A knockout pin 348 for extruding a forged product is arranged on the lower side of the cavity 346, which is movable back and forth along a hole 350 formed through the second die holder 316 and the third die holder 318. A secondary formed product 148 as shown in FIG. 12 is charged as a forging material in the cavity 346.

An elevating unit 354, which is connected to the ram 36 of the mechanical press 31 shown in FIG. 43 for making displacement along the vertical direction integrally with the ram 36 in accordance with the driving action of the mechanical press 31, is provided at an upper position separated by a predetermined distance from the forcible insertion ring 320.

The elevating unit 354 has a buffering mechanism 356 which is provided in order that the punch 340 abuts against the forging material to start the forging, and the upper and lower dies make abutment before arrival at the bottom dead center to complete the forging for the forging material so that the residual displacement amount is absorbed thereafter until arrival at the bottom dead center.

The buffering mechanism 356 has a pressure chamber 358 formed therein, and it comprises a cylindrical block member 362 with a bottom having a piston 360 which is provided vertically displaceably along the pressure chamber 358, and a pair of connecting blocks 366*a*, 366*b* which are coupled to the block member 362 in a liquid-tight manner and which are formed with a passage 364 communicating with the pressure chamber 358. A ring-shaped stopper 368 is fixed on the bottom surface of the block member 362 in order to prevent the piston 360 from descending movement.

A check valve 371 and a pressure oil supply source 373 are connected via a tube 370 to one connecting block 366*a*. A relief valve 377 and a tank 379 for storing the pressure oil are connected via a tube 375 to the other connecting block 366*b*. A predetermined amount of pressure oil, which is supplied from the pressure oil supply source 373, is charged in the pressure chamber 358 and the passage 364. A ring-shaped high pressure packing 372, a low pressure packing 374, and a wear plate 376 are installed to annular grooves on the outer circumference of the piston 360 respectively.

A punch plate 378 is fixed on the bottom surface of the piston 360. A punch 340 is fixed on the punch plate 378 by the aid of a holder 380 which surrounds a part of the outer circumferential surface. A cylindrical member 382, which is formed of a cylindrical metal material, is externally fitted to the outer circumference of the holder 380. A second plate 342 is fixedly provided on the bottom surface of the holder 380.

The cylindrical member 382 is formed of a metal material such as SKD11, FC25, or FC30 (according to JIS). The first ring member 334 is preferably formed of a material harder than that for the cylindrical member 382.

The punch 340 is provided displaceably in the vertical direction integrally with the elevating unit 354 in accordance with the guiding action of the plurality of guide means 112*a* to 112*d* provided vertically on the first die holder 314.

The forging die apparatus 300 according to the third embodiment of the present invention is basically constructed as described above. Next, its operation, function, and effect will be explained.

At first, the following preparatory operation is performed. That is, the punch 340 is allowed to be in a state of being positioned with respect to the cavity 346 formed by the upper die 326 and the lower die 328. The pressure chamber 358 is previously charged with a predetermined amount of pressure oil via the passage 364 communicating with the check valve 371 in accordance with the driving action of the pressure oil supply source 373.

Subsequently, the secondary formed product 148 as the forging material is charged in the cavity 346 in a state in which the punch 340 is arranged at an unillustrated lifted position. The punch 340 is lowered integrally with the elevating unit 354 connected to the ram 36 in accordance with the driving action of the mechanical press 31 to give the state as shown in FIG. 28. Thus, the forging is started.

When the punch 340 is lowered integrally with the elevating unit 354, any unbalanced load in the lateral direction is appropriately absorbed by the plurality of guide means 112*a* to 112*d* provided between the elevating unit 354 and the first die holder 314. Accordingly, the punch 340 can be smoothly inserted under pressure toward the center of the hole 332 of the first and second ring members 334, 336 arranged coaxially with the cavity 346 by the aid of the cylindrical member 382.

When the forging is started, the cylindrical member 382, which is externally fitted to the part of the outer circumferential surface of the punch 340, proceeds in accordance with the guiding action of the annular groove 138 formed at the upper end of the hole 332 of the first ring member 334. The punch 340 is further lowered, and thus the punch 340, the holder 380, and the cylindrical member 382 are integrally displaced in a state of being forcibly inserted into the hole 332 of the first ring member 334.

Figure 30:
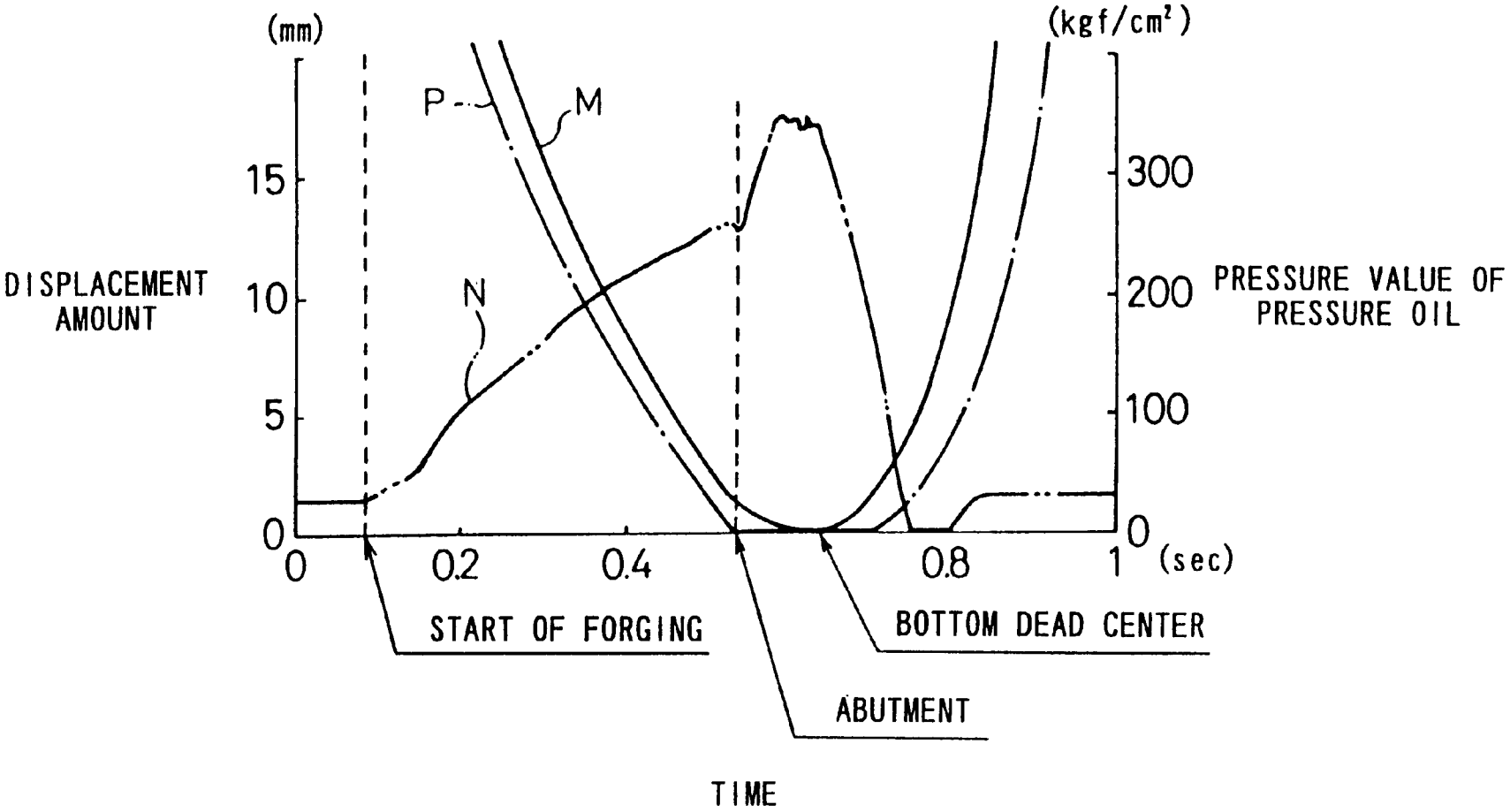
FIG. 30 illustrates a relationship between the displacement amount of the punch and the pressure value of pressure oil.

FIG. 30 shows the relationship between the displacement amount of the punch 340 and the pressure oil charged in the pressure chamber 358. In FIG. 30, a curve M indicated by a continuous line represents the displacement amount of the punch 340 displaced integrally with the ram 36 in accordance with the driving action of the mechanical press 311. A curve N indicated by a two-dot chain line represents the pressure value of the pressure oil charged in the pressure chamber 358. A curve P indicated by a chain line represents the distance of separation R (see FIG. 28) between the second plate 342 disposed on the displacement side and the first plate 344 disposed on the fixation side.

When the ram 36 of the mechanical press 31 is displaced downwardly from the predetermined lifted position, and the punch 340, the second plate 342, and other components are lowered integrally with the ram 36, then the spacing distance of separation R between the first plate 344 on the fixation side and the second plate 342 on the displacement side is gradually decreased. The piston 360 is held by the stopper 368, and it is in a state of being prevented from downward displacement. The pressure of the pressure oil charged in the pressure chamber 358 is gradually increased after the start of the forging in accordance with the increase in load applied to the punch 340.

The operating pressure for the relief valve 377 is set such that the reaction force of the piston 360 is not less than the forging load on the forging material, and it is not more than the overloaded forging load. The forging load on the forging material is supported by the pressure oil charged in the pressure chamber 358.

Figure 29:
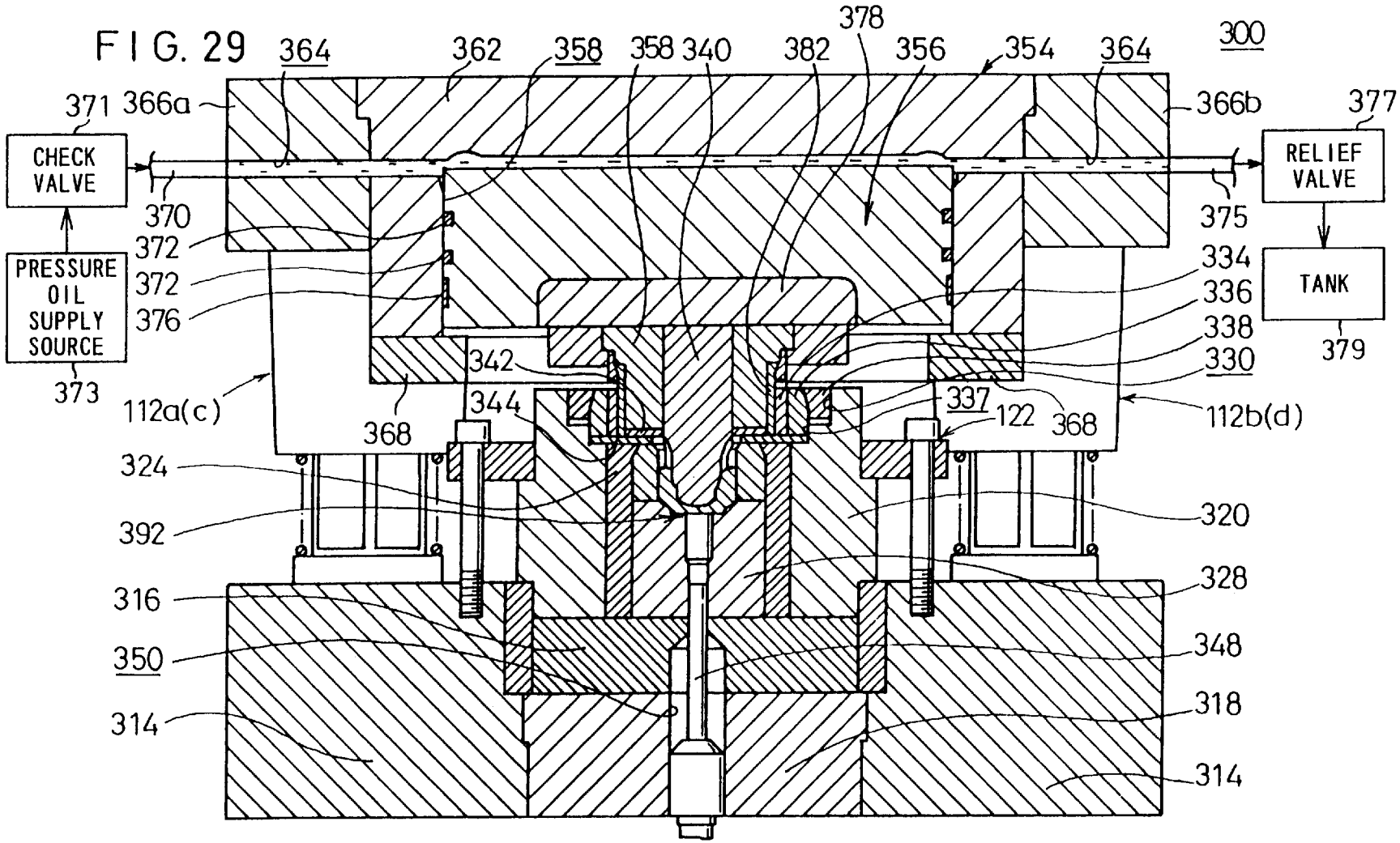
FIG. 29 illustrates an operation depicting a state in which a punch is lowered from a forging start position shown in FIG. 28, and the forging is completed.

The second plate 342 abuts against the first plate 344 immediately before the punch 340 arrives at the bottom dead center after the punch 340 is further lowered from the state shown in FIG. 28. That is, the distance of separation R between the first plate 344 and the second plate 342 becomes zero. Thus, the downward displacement of the punch 340 is regulated, the thickness for the forging material is correctly regulated, and the forging is ended. Further, the punch 340 is lowered by a minute distance, and the oil pressure in the pressure chamber 358 arrives at the preset pressure described above. Accordingly, the relief valve 377 is open, the pressure oil in the pressure chamber 358 is discharged, and the state shown in FIG. 29 is achieved in accordance with the stroke action of the piston 360.

During this process, in the embodiment of the present invention, the amount of variation, which is brought about, for example, by elongation of the connecting rod 35 and the frames 33*a*, 33*b* of the mechanical press 31 to cause variation in thickness dimension of the forging material in ordinary cases, is absorbed as the change in stroke amount of the piston 360. Further, the thickness dimension of the forging material is determined by the abutment between the upper die and the lower die. Therefore, no influence is exerted by the elongation of the frames 33*a*, 33*b* and other components.

As described above, the dimension of the bottom thickness T (see FIG. 31) of a cup 394 of an outer cup obtained as a forged product 392 is determined by the abutment between the second plate 342 disposed on the side of the punch 340 and the first plate 344 disposed on the side of the forcible insertion ring 320. Therefore, no dispersion occurs in the dimension of the bottom thickness T of the cup 394 of the outer cup obtained as the forged product 392. The dimensional accuracy of the bottom thickness T of the cup 394 is maintained highly accurately.

Figure 32:
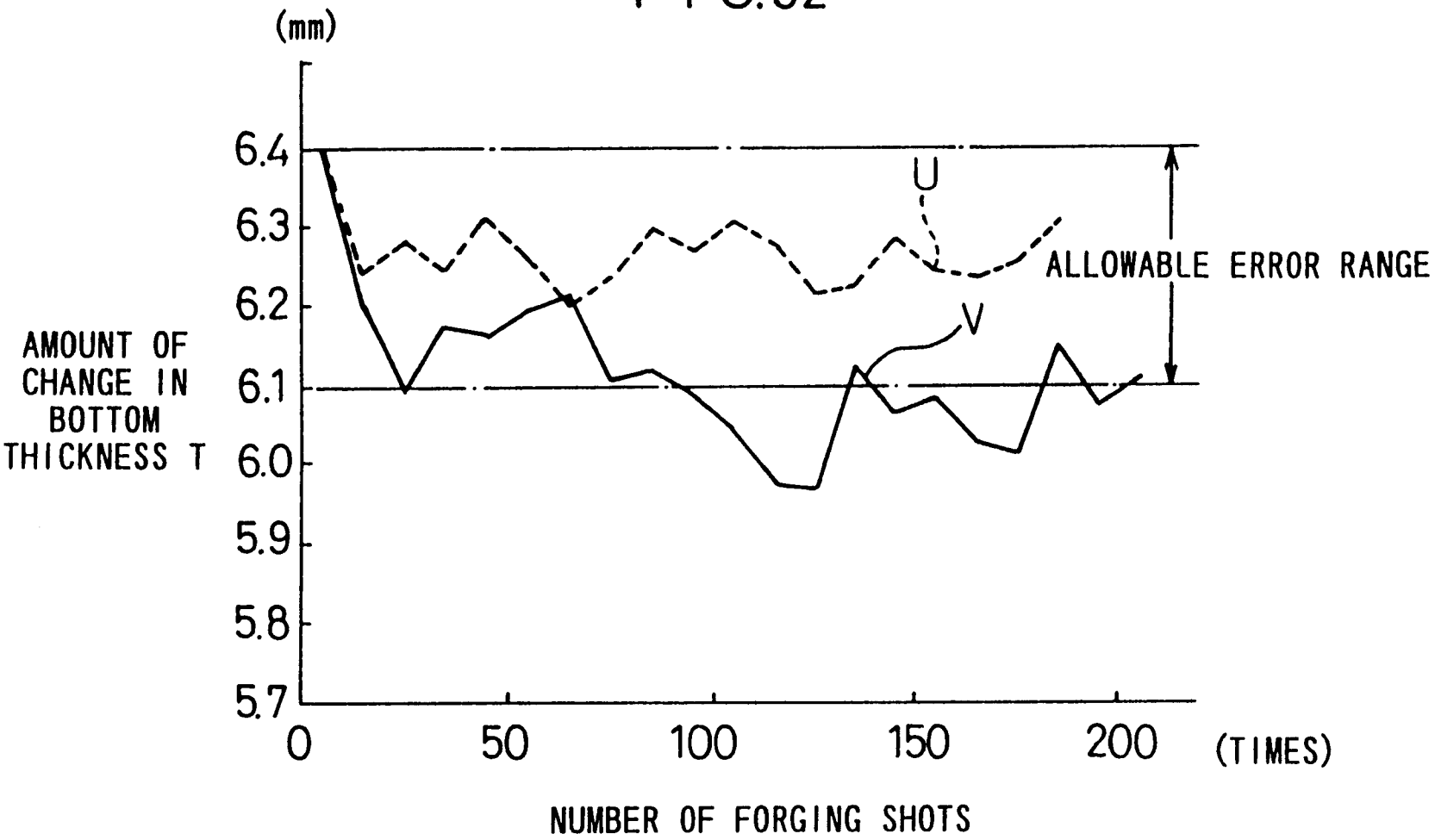
FIG. 32 illustrates a relationship between the number of forging shots and the amount of change in bottom thickness of the cup of the outer cup obtained as the forged product.

Next, FIG. 32 shows the relationship between the number of forging shots and the amount of change in bottom thickness T. When the forging die apparatus 300 according to the embodiment of the present invention is used, the amount of change in bottom thickness T of the cup 394 is maintained within a range of allowable error even if the number of times of forging shots is increased, as indicated by a broken line U. On the contrary, when an ordinary forging die apparatus concerning Comparative Example (not shown) is used, the following inconvenience arises as indicated by a continuous line V. That is, as the number of forging shots is increased, the amount of change in bottom thickness T exceeds the allowable error, resulting in occurrence of dispersion.

The punch 340 is lowered as described above, and it arrives at the forging end position shown in FIG. 29 from the forging start position shown in FIG. 28. Accordingly, the forging material is forged by the aid of the punch 340, the lower die 328, and the upper die 326. The forging material causes plastic flow in conformity with the shape of the cavity 346.

After the forging is completed as described above, the punch 340 is lifted to the predetermined position integrally with the elevating unit 354 connected to the ram 36 in accordance with the driving action of the mechanical press 31. Accordingly, the punch 340, the holder 380, and the cylindrical member 382 are separated from the hole 332 of the first ring member 334 to give a waiting state for the next step. The forged product 392 as a tertiary formed product (hereinafter also referred to as "tertiary formed product 392", if necessary) (see FIG. 31) is taken out in accordance with the displacement action of the knockout pin 348.

In the embodiment of the present invention, the second plate 342 disposed on the displacement side abuts against the first plate 344 on the fixation side, and the distance of separation therebetween R becomes zero, immediately before the punch 340 arrives at the bottom dead center. Accordingly, the downward displacement of the punch 340 is regulated. Thus, it is possible to obtain a substantially constant dimension of the bottom thickness T of the cup 394 of the outer cup obtained as the forged product 392. Therefore, it is possible to highly accurately maintain the thickness accuracy of the obtained forged product 392.

In the embodiment of the present invention, it is unnecessary to perform, after the forging, the cutting processing which has been required for the conventional technique in order to obtain a constant bottom thickness dimension of the cup 394 of the outer cup. Accordingly, it is possible to simplify the production process and improve the production efficiency.

In the embodiment of the present invention, the forming load applied to the forging material can be set to be larger than the minimum forming load which is actually required and smaller than the overloaded forming load. Therefore, it is possible to prevent the mechanical press 31 from being stopped in the locked state, and it is possible to continuously perform the forging.

In the embodiment of the present invention, the buffering mechanism 356 is provided at the elevating unit 354 disposed on the displacement side. However, there is no limitation thereto. The buffering mechanism 356 may be provided on the fixation side, for example, on the upper die 326 and the lower die 328.

Figure 33:
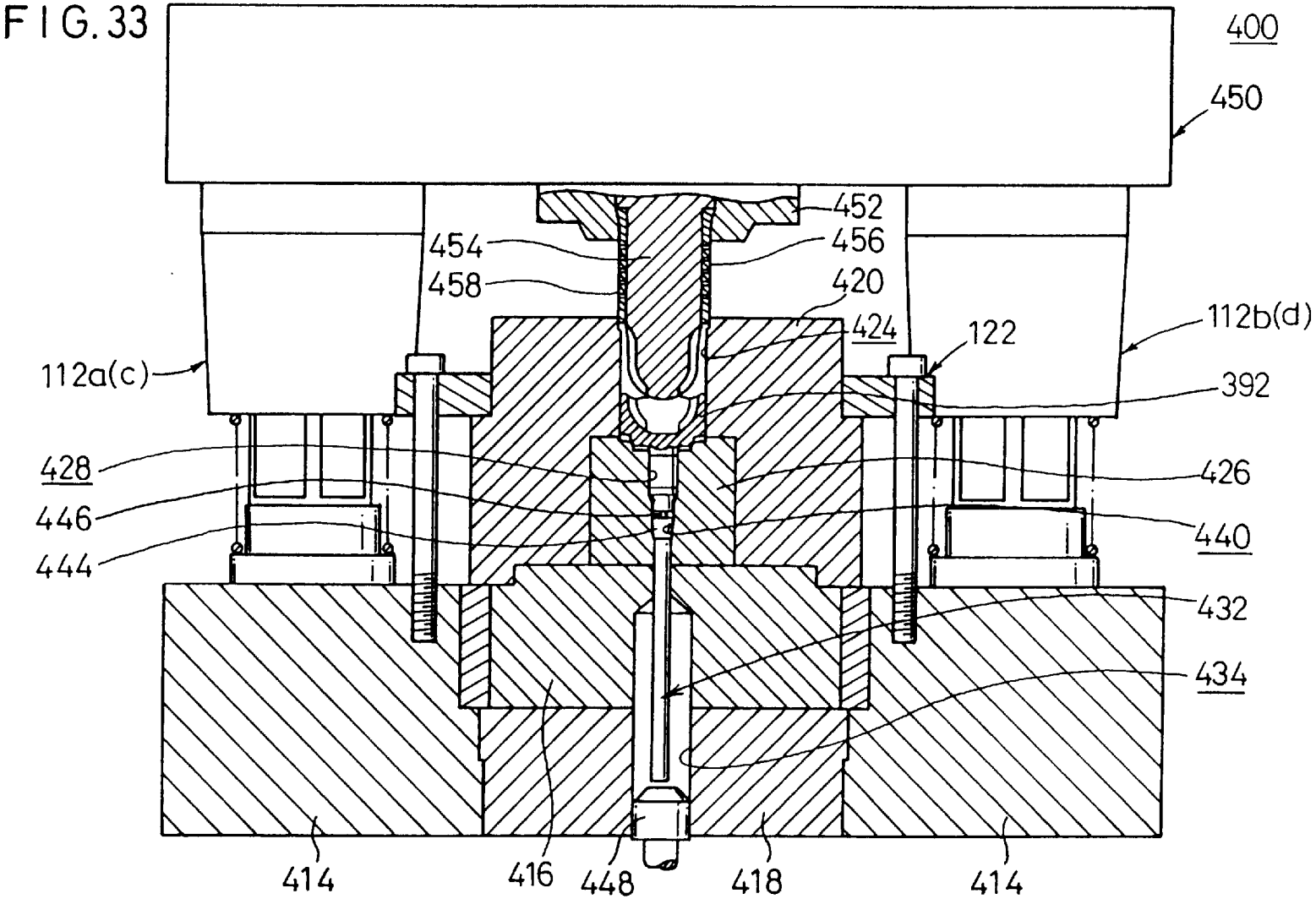
FIG. 33 shows a longitudinal sectional view illustrating a forging die apparatus according to a fourth embodiment of the present invention.

Next, a forging die apparatus 400 according to a fourth embodiment of the present invention is shown in FIG. 33.

The forging die apparatus 400 comprises a first die holder 414 on which a plurality of guide means 112*a* to 112*d* (see FIG. 4) are vertically provided in the close vicinity of four corners, and second and third die holders 416, 418 which are provided and stacked at the center of the first die holder 414.

A cylindrical first die member 420 is fixed on the second die holder 416 by the aid of a clamping means 122. A cylindrical second die member 426, which has a smaller diameter than the first die member 420, is integrally joined to a step section of a first hole 424 of the first die member 420.

As shown in FIG. 33, the first die member 420 and the second die member 426 may be integrally formed respectively. Alternatively, the first die member 420 and the second die member 426 may be formed while dividing them into a plurality of pieces respectively.

Figure 31:
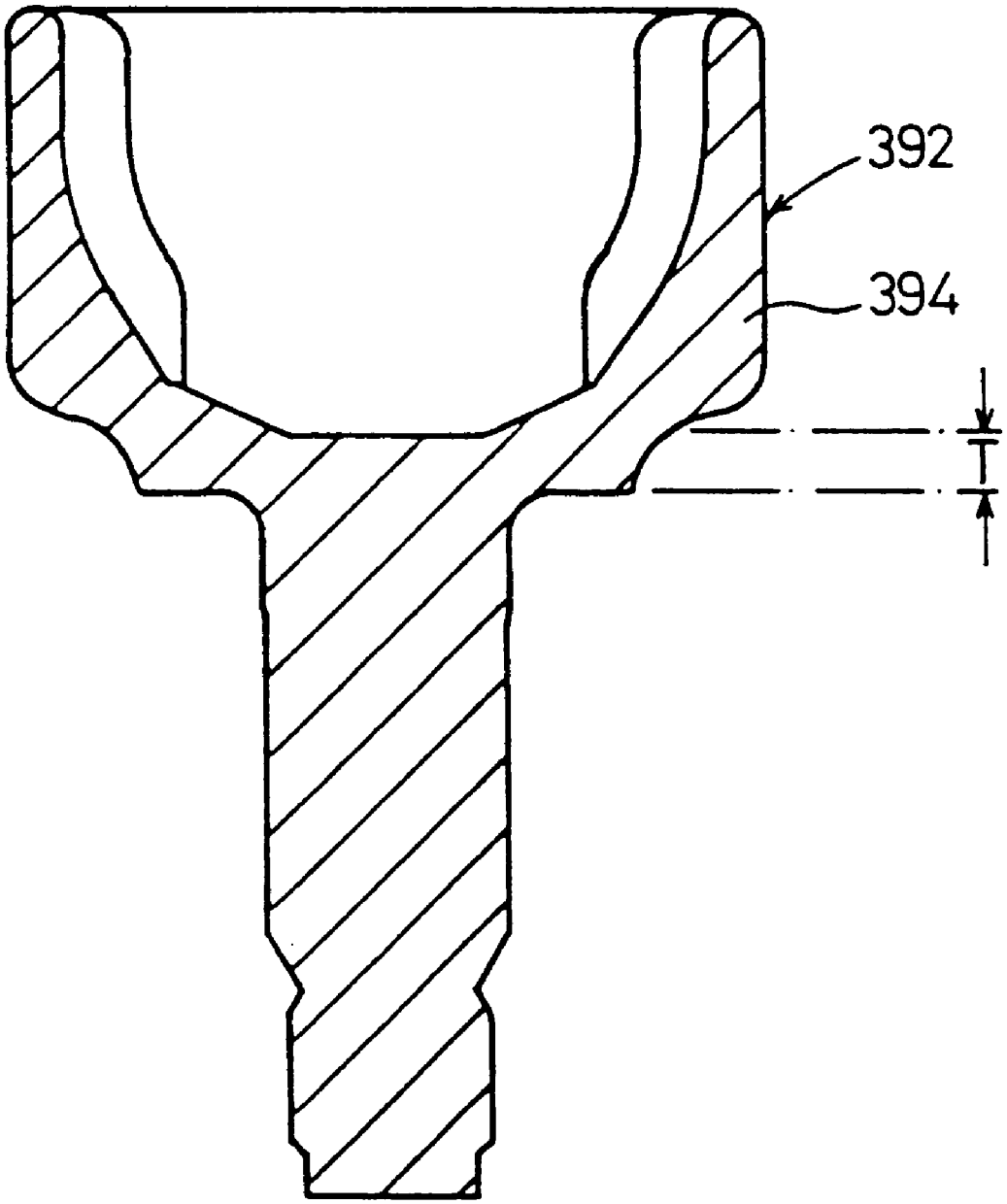
FIG. 31 illustrates a longitudinal sectional view illustrating the dimension of bottom thickness of a cup of an outer cup obtained as a forged product.

In this embodiment, a cavity 430 (see FIG. 35), in which the forging material is arranged, is formed by the first hole 424 and a second hole 428 which are formed in the first die member 420 and the second die member 426 respectively. A knockout pin 432, which is used to extrude the forged product from the cavity 430, is arranged under the cavity 430 movably back and forth along a hole 434 formed through the second die holder 416 and the third die holder 418. A tertiary formed product 392 as shown in FIG. 31 is charged as the forging material in the cavity 430.

A shoulder 438, which has a curved configuration with a predetermined radius of curvature, is formed at an upper portion of the second hole 428 of the second die member 426. A tapered hole 440, which has its diameter gradually increasing in the upper direction over a predetermined range, is formed at a lower portion of the second hole 428. A portion of the second hole 428, which is disposed over the tapered hole 440, is formed to have a diameter larger than the increased diameter of the tapered hole 440.

Figure 35:
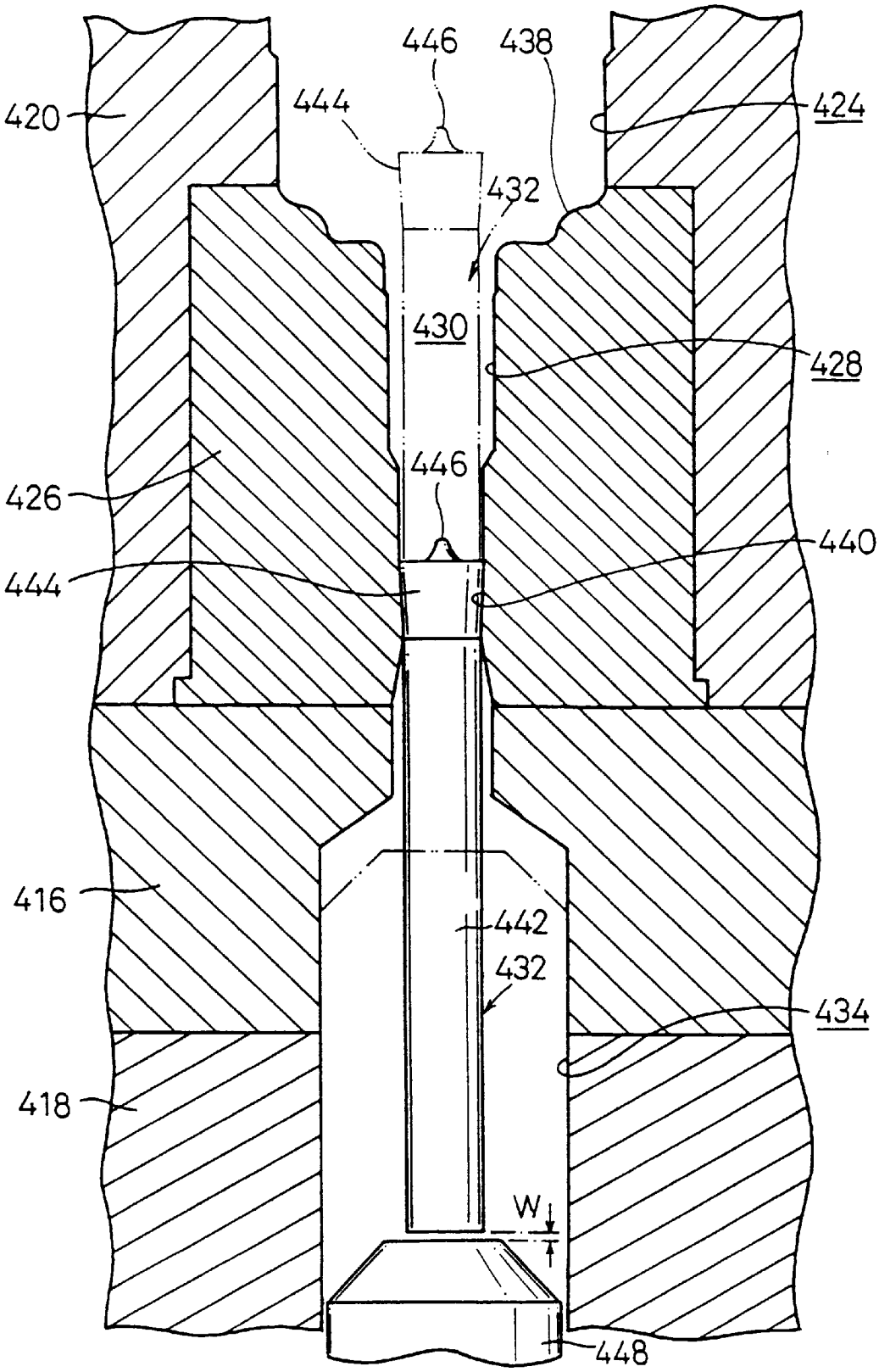
FIG. 35 shows a partial magnified longitudinal sectional view illustrating the forging die apparatus shown in FIG. 33.

As shown in FIG. 35, the knockout pin 432 comprises a main pin body 442 which has a substantially uniform diameter and which is formed to have a linear cross section, a tapered section 444 which is formed at one end of the main pin body 442 and which has its diameter gradually increasing in the upward direction corresponding to the tapered hole 440, and a projection 446 which is formed at the center of the upper surface of the tapered section 444 and which protrudes by a predetermined length along the axial direction.

A diametrally expanded pin 448 is arranged under the knockout pin 432 while being separated by a predetermined clearance W. An unillustrated displacement member is connected to the diametrally expanded pin 448. The diametrally expanded pin 448 and the knockout pin 432 can be moved back and forth in an integrated manner in accordance with the energizing action of the displacement member.

The knockout pin 432 has its tapered section 444 which is engaged with the tapered hole 440 of the second die member 426. The clearance W is formed between the knockout pin 432 and the diametrally expanded pin 448. Accordingly, the knockout pin 432 is suspended in a state of being positioned beforehand so that the projection 446 is arranged at the center of the tapered hole 440.

An elevating member 450, which is connected to the ram 36 of the mechanical press 31 described above for making displacement along the vertical direction integrally with the ram 36 in accordance with the driving action of the mechanical press 31, is provided at an upper position separated by a predetermined distance from the first die member 420. A punch 454 is fixed to the elevating member 450 by the aid of a jig 452. A cylindrical member 456, which is formed of a cylindrical metal material, is externally fitted to a predetermined portion of the outer circumference of the punch 454.

As shown in FIG. 8, graphite 156 is embedded in a plurality of holes of the cylindrical member 456, making it possible to appropriately maintain the lubricating characteristic when the cylindrical member 456 is forcibly inserted into the hole 424 of the first die member 420. The diameter on the outer circumferential side of the cylindrical member 456 externally fitted to the punch 454 is set to be slightly larger than the diameter on the inner circumferential side of the first hole 424 of the first die member 420.

The cylindrical member 456 is formed of a metal material such as SKD11, FC25, or FC30 (according to JIS). The first die member 420 is preferably formed of a material harder than that for the cylindrical member 456 in order to avoid occurrence of scuffing.

The punch 454 is provided displaceably in the vertical direction integrally with the elevating member 450 in accordance with the guiding action of the plurality of guide means 112*a* to 112*d* (see FIG. 4) provided vertically on the first die holder 414.

The forging die apparatus 400 according to the fourth embodiment of the present invention is basically constructed as described above. Next, its operation, function, and effect will be explained.

The forging die apparatus 400 according to the embodiment of the present invention is used to further apply quaternary forging to the tertiary formed product 392 shown in FIG. 31 as the forging material.

Figure 36:
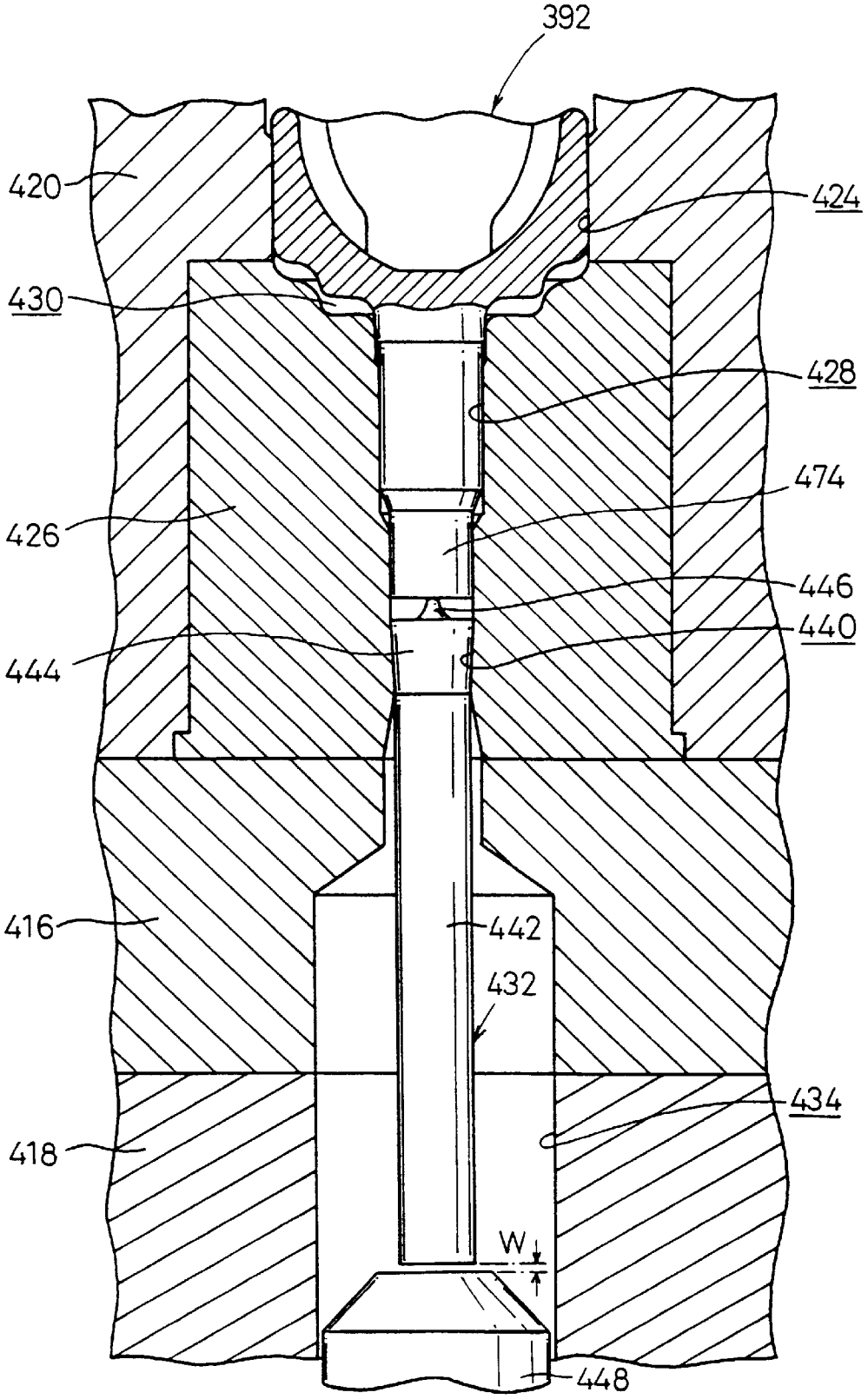
FIG. 36 shows a partial magnified longitudinal sectional view illustrating a state in which a forging material is charged in a cavity.

The tertiary formed product 392 as the forging material is charged in the cavity 430 as shown in FIG. 36 in a state in which the punch 454 is arranged at an unillustrated lifted position. The punch 454 is lowered integrally with the elevating member 450 connected to the ram 36 in accordance with the driving action of the mechanical press 31 to give the state as shown in FIG. 33. Thus, the forging is started.

When the punch 454 is lowered integrally with the elevating member 450, any unbalanced load in the lateral direction is appropriately absorbed by the plurality of (for example, four of) guide means 112*a* to 112*d* provided between the elevating member 450 and the first die holder 414.

When the forging is started, the cylindrical member 456, which is externally fitted to the part of the outer circumferential surface of the punch 454, proceeds along the first hole 424 of the first die member 420. The punch 454 is further lowered, and thus the punch 454 and the cylindrical member 456 are integrally displaced in a state of being forcibly inserted into the first hole 424 of the first die member 420.

Figure 34:
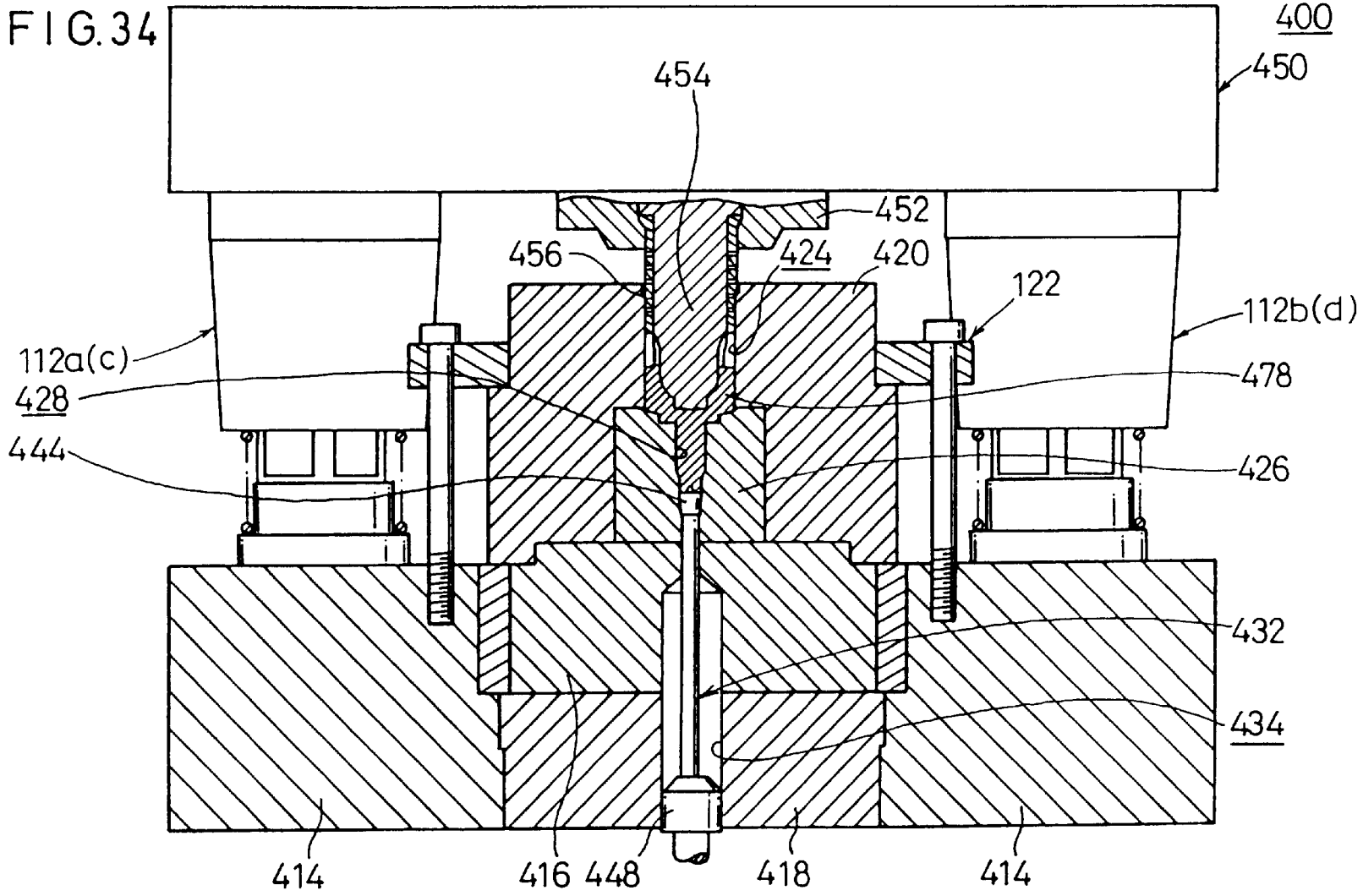
FIG. 34 illustrates an operation depicting a state in which a punch is lowered from a forging start position shown in FIG. 33, and the forging is completed.

The punch 454 is lowered as described above, and it arrives at the forging end position shown in FIG. 34 from the forging start position shown in FIG. 33. Accordingly, the forging material is forged by the aid of the punch 454, the first die member 420, and the second die member 426. The forging material causes plastic flow in conformity with the shape of the cavity 430.

Figure 37:
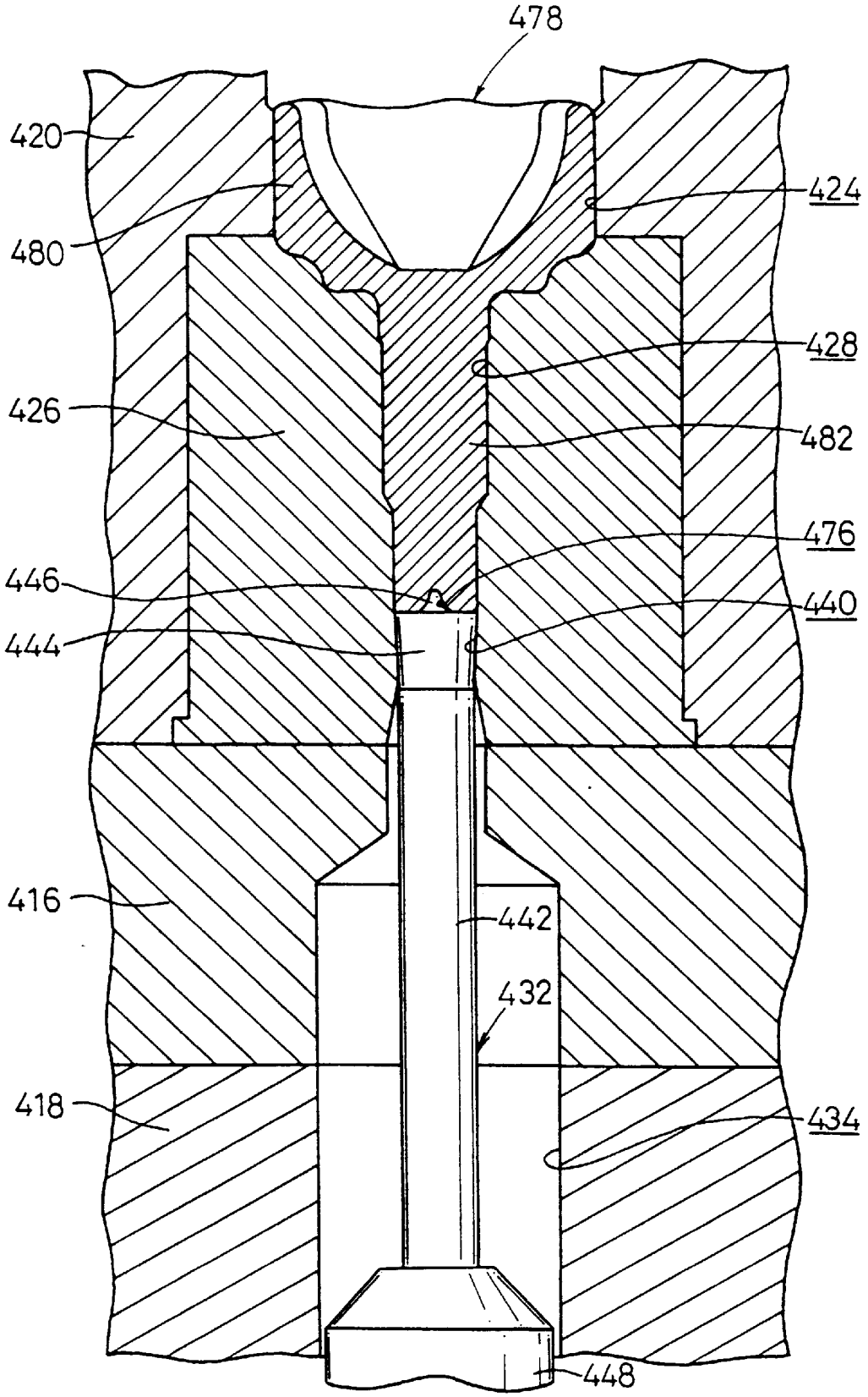
FIG. 37 shows a partial magnified longitudinal sectional view illustrating a state which is attained after the forging material shown in FIG. 36 is subjected to forging.

When the pressurizing force is applied to the forging material by the aid of the punch 454, a hole is made at one end of the shaft 474 of the forging material (see FIG. 36) by means of the projection 446 of the knockout pin 432. Thus, the centering hole 476 is formed at the center of the shaft 474 (see FIG. 37).

In this embodiment, the knockout pin 432 is inserted in the state of being positioned beforehand so that the projection 446 is arranged at the center of the tapered hole 440. Therefore, the centering hole 476 can be correctly made at the center of one end of the shaft 474 of the forging material. In other words, the center of the centering hole 476 formed simultaneously with the forging can be allowed to correctly coincide with the axis of the forging material.

After the formation of the centering hole 476 is started, the clearance W between the knockout pin 432 and the diametrally expanded pin 448 becomes zero on, account of the forming load applied to the knockout pin 432. The forming load is supported by the abutment therebetween (see FIG. 37). As a result, the forming load applied to the knockout pin 432 is absorbed by the aid of the clearance W. Thus, it is possible to protect the knockout pin 432.

Figure 38:
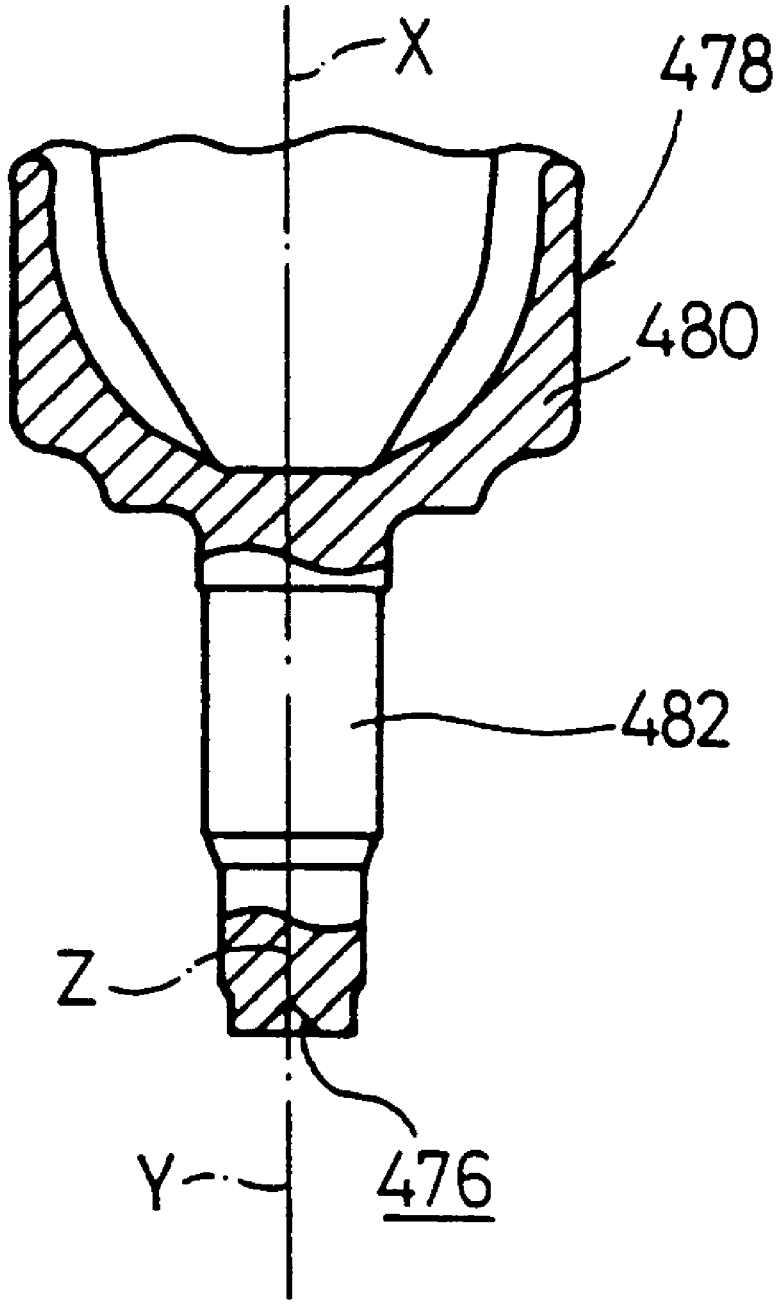
FIG. 38 shows a partial longitudinal sectional view illustrating a forged product formed by forging performed by using the forging die apparatus shown in FIG. 33.
Figure 39:
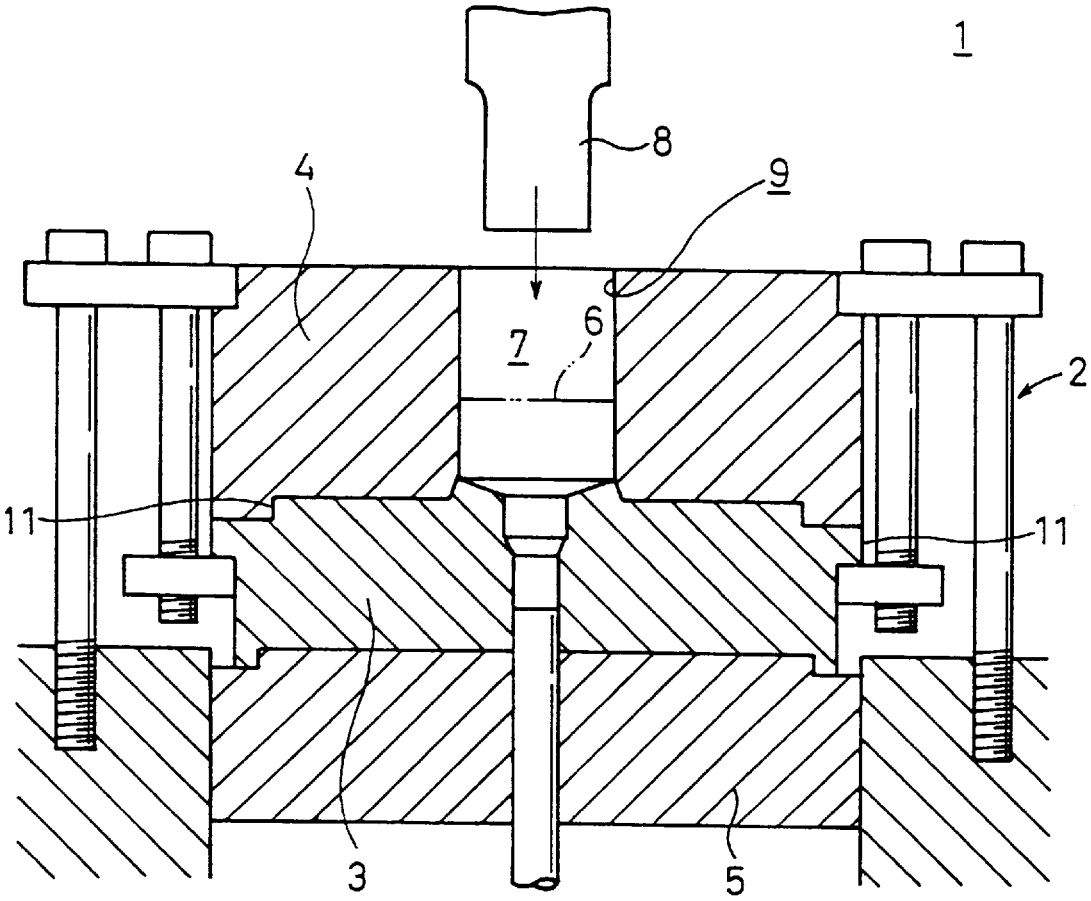
FIG. 39 shows a longitudinal sectional view illustrating a cold forging die suggested by the present applicant.
Figure 40:
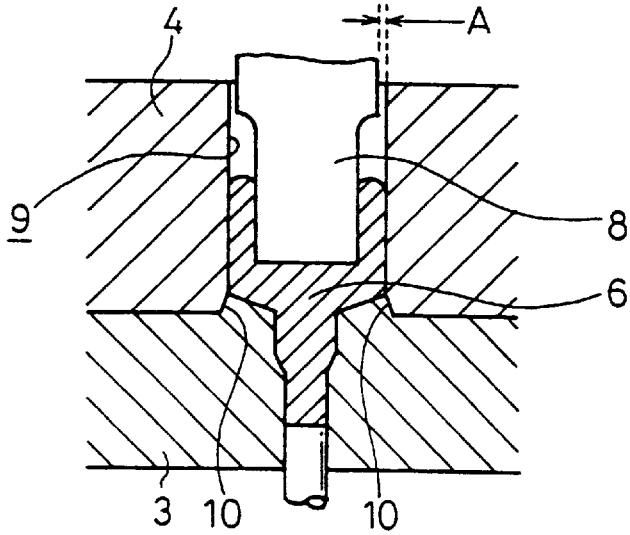
FIG. 40 shows a partial longitudinal sectional view illustrating a state in which a pressurizing force is applied to a forging material by using the cold forging die shown in FIG. 39.
Figure 41:
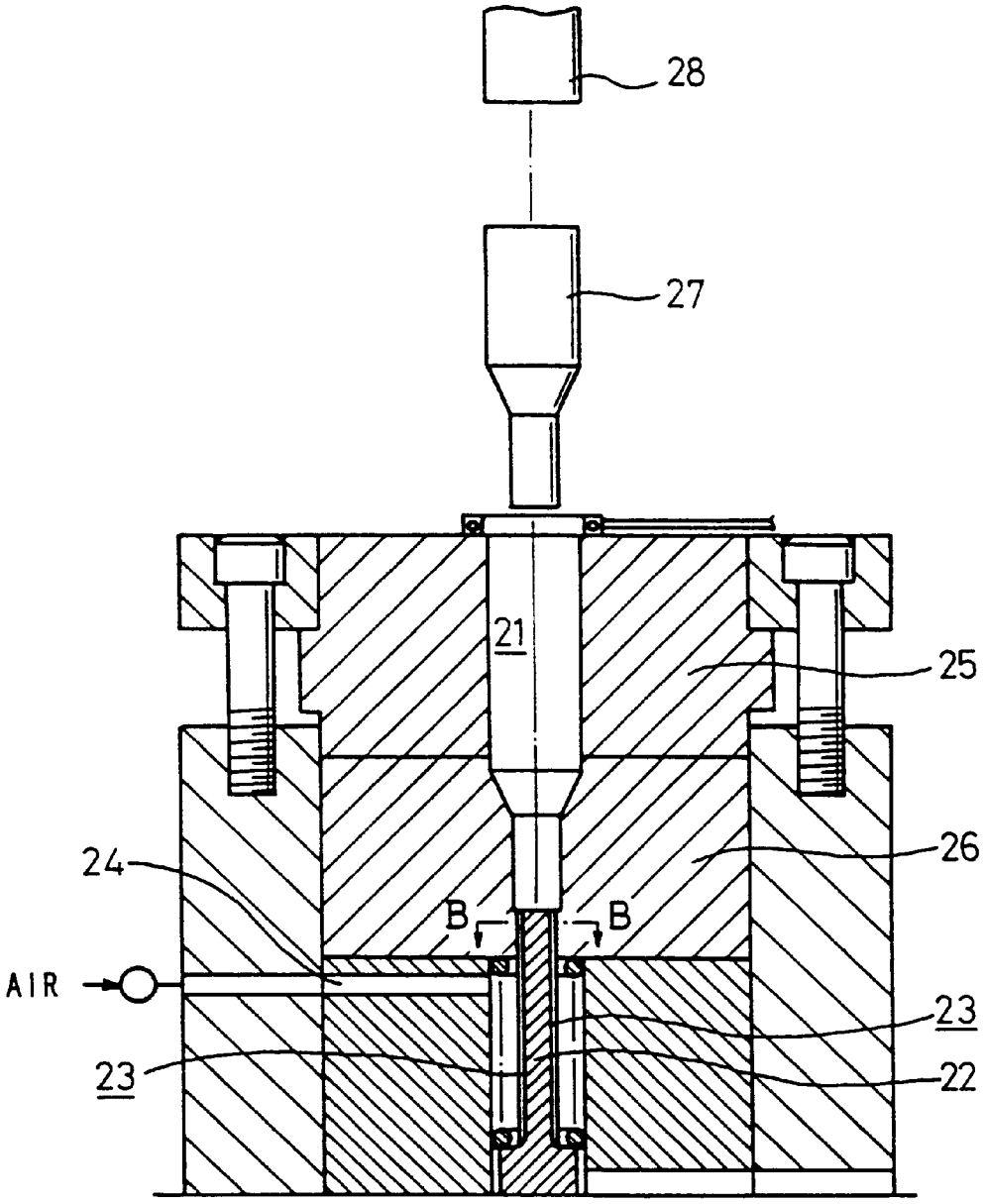
FIG. 41 shows a longitudinal sectional view illustrating a forging die apparatus to which a method for cooling the die suggested by the present applicant is applied.
Figure 42:
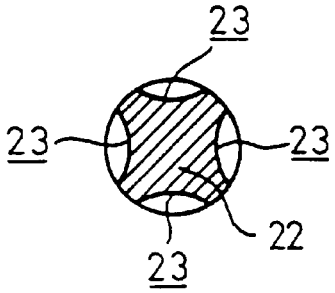
FIG. 42 shows a cross-sectional view taken along a line B—B shown in FIG. 41.

After the forging is completed as described above, the punch 454 is lifted to the predetermined position integrally with the elevating member 450 connected to the ram 36 in accordance with the driving action of the mechanical press 31. Accordingly, the punch 454 and the cylindrical member 456 are separated from the first hole 424 of the first die member 420 to give a waiting state for the next forging material. The forged product 474 as a quaternary formed product (see FIG. 38) is taken out by integrally lifting the diametrally expanded pin 448 and the knockout pin 432 up to the position indicated by two-dot chain lines shown in FIG. 35 in accordance with the driving action of the unillustrated displacement means.

In the embodiment of the present invention, when the pressurizing force is applied to the forging material, the cylindrical member 456, which is externally fitted to the punch 454, is in the state of being forcibly inserted into first hole 424 of the first die member 420. The punch 454 is lowered while maintaining the forcibly inserted state.

Therefore, in the embodiment of the present invention, the pressurizing force is applied to the forging material in the state in which the punch 454 is forcibly inserted into the first hole 424 of the first die member 420 by the aid of the cylindrical member 456, and the punch 454 does not cause any centering deviation in the lateral direction. Accordingly, it is possible to highly accurately maintain the coaxial degree among the center line Z of the centering hole 476, the axis X of the cup 480, and the axis Y of the shaft 484 of the outer cup obtained as the forged product 478 (see FIG. 38).

What is claimed is:

1. A forging die apparatus comprising:

a die member formed with a cavity for arranging a forging material therein;

a hole formed in said die member, said hole having a tapered portion therein having a diameter gradually changing from one end of the other end of said tapered portion;

a punch for applying a pressurized force to said forging material arranged in said cavity;

a pin member provided movably back and forth through said hole formed in said die member to make communication with said cavity, for extruding a forged product obtained by forging from said cavity, said pin member having a tapered section formed at one end thereof having a shape corresponding to said tapered portion of said hole, and said pin member further comprising a projection provided at a center of one end of said pin member facing said cavity, whereby said projection is positioned at a center of said hole by engaging said tapered section with said tapered portion of said hole; and a pressing member arranged in said hole for pressing said pin member in a direction toward said cavity;

wherein a clearance exists between said pin member and said pressing member prior to application of a pressurizing force, said tapered section of the pin member being further displaceable within said tapered portion of the hole upon application of said pressurizing force to cause said pin member to come into contact with said pressing member, and wherein a centering hole is formed at a center of one end of said forging material along said axial direction by the aid of said projection in accordance with an action of said pressurizing force exerted by said punch on said forging material.

2. The apparatus according to claim 1, wherein said tapered section of said pin member extends a predetermined distance from said one end towards a distal end thereof and said tapered portion of said hole extends a predetermined distance within said die member for aligning said projection provided on said pin member relative to said hole.

3. The apparatus according to claim 2, wherein said tapered portion of said pin member decreases in cross-sectional area from said one end thereof towards said distal end thereof.

4. The apparatus according to claim 2, wherein said tapered portion of said hole decreases in cross-sectional area to mate with said tapered portion of said pin member for aligning said projection provided on said pin member relative to said hole.

5. The apparatus according to claim 1, wherein said centering hole formed in said forging material is coaxial with a centerline of said punch.

* * * * *